US011019450B2

(12) United States Patent
Stanek et al.

(10) Patent No.: US 11,019,450 B2
(45) Date of Patent: May 25, 2021

(54) DIRECTIONAL AWARENESS AUDIO COMMUNICATIONS SYSTEM

(71) Applicant: OTTO ENGINEERING, INC., Carpentersville, IL (US)

(72) Inventors: Daniel F. Stanek, Chicago, IL (US); Bernard L. Knych, Arlington Heights, IL (US)

(73) Assignee: OTTO ENGINEERING, INC., Carpentersville, IL (US)

( * ) Notice: Subject to any disclaimer, the term of this patent is extended or adjusted under 35 U.S.C. 154(b) by 0 days.

(21) Appl. No.: 16/654,580

(22) Filed: Oct. 16, 2019

(65) Prior Publication Data

US 2020/0137509 A1 Apr. 30, 2020

Related U.S. Application Data

(60) Provisional application No. 62/876,479, filed on Jul. 19, 2019, provisional application No. 62/852,452, (Continued)

(51) Int. Cl.
*H04S 7/00* (2006.01)
*H04R 1/40* (2006.01)
(Continued)

(52) U.S. Cl.
CPC ..... *H04S 7/304* (2013.01); *G08B 7/06* (2013.01); *H04R 1/403* (2013.01); *H04R 3/12* (2013.01);
(Continued)

(58) Field of Classification Search
CPC ..... H04S 7/304; H04S 3/008; H04S 2400/01; H04S 2400/13; H04S 2420/01;
(Continued)

(56) References Cited

U.S. PATENT DOCUMENTS 7,843,486 B1 11/2010 Blair et al.
7,853,030 B2 12/2010 Grasbon et al.
(Continued)

OTHER PUBLICATIONS

International Search Report and Written Opinion of the International Searching Authority, or the Declaration for International Application No. PCT/US19/56520, dated Jan. 13, 2020, 16 pages.

*Primary Examiner* — Mark Fischer
(74) *Attorney, Agent, or Firm* — McAndrews, Held & Malloy, Ltd.

(57) ABSTRACT

Various embodiments include a directional awareness audio communication system and method. The system may include remote speaker/transmitting device(s) and listener/receiving device(s). The speaker/transmitting device(s) may send real-time location information with audio or separate from the audio to the listener/receiving device(s). The listener/receiving device(s) use the speaker/transmitting device (s) location information relative to the listener/receiving device location and orientation to perform audio processing on the transmitted audio signal. The listener/receiving device(s) provide the processed audio signal in stereo (i.e., at least two speakers such as left and right headphones, vehicle speakers, control center speakers, surround sound speakers, etc.) to a user of the listener/receiving device. The listener/receiving device(s) provides a warning and outputs standard audio if the real-time location information of the speaker/transmitting device(s) is unavailable or unreliable. In various embodiments, the listener device provides haptic and/or visual feedback of the speaker device location with respect to the listener device location.

24 Claims, 18 Drawing Sheets

Related U.S. Application Data filed on May 24, 2019, provisional application No. 62/750,007, filed on Oct. 24, 2018.

(51) Int. Cl.

| | |
|---|---|
| ***H04R 3/12*** | (2006.01) |
| ***H04R 5/033*** | (2006.01) |
| ***H04R 29/00*** | (2006.01) |
| ***H04S 3/00*** | (2006.01) |
| ***G08B 7/06*** | (2006.01) |

(52) U.S. Cl.

CPC ..... *H04R 5/033* (2013.01); *H04R 29/002* (2013.01); *H04S 3/008* (2013.01); *H04S 2400/01* (2013.01); *H04S 2400/13* (2013.01); *H04S 2420/01* (2013.01)

(58) Field of Classification Search

CPC . G08B 7/06; H04R 1/403; H04R 3/12; H04R 5/033; H04R 29/002

See application file for complete search history.

(56) References Cited

U.S. PATENT DOCUMENTS

| | | | |
|---|---|---|---|
| 8,027,477 | B2 | 9/2011 | Wang |
| 8,073,125 | B2 | 12/2011 | Zhang et al. |
| 8,094,834 | B1 | 1/2012 | Brungart |
| 8,405,323 | B2 | 3/2013 | Finney et al. |
| 8,718,301 | B1 | 5/2014 | Jouppi et al. |
| 8,781,818 | B2 | 7/2014 | Janse et al. |
| 9,009,057 | B2 | 4/2015 | Koninklijke |
| 9,084,058 | B2 | 7/2015 | Reilly et al. |
| 9,179,236 | B2 | 11/2015 | Robinson et al. |
| 9,185,508 | B2 | 11/2015 | Gleim |
| 9,232,319 | B2 | 1/2016 | Wang |
| 9,237,398 | B1 | 1/2016 | Algazi et al. |
| 9,294,862 | B2 | 3/2016 | Kim et al. |
| 9,318,096 | B2 | 4/2016 | Pearlstein |
| 9,369,801 | B2 | 6/2016 | Carlsson et al. |
| 9,374,641 | B2 | 6/2016 | Rodigast et al. |
| 9,426,548 | B2 | 8/2016 | Rayner et al. |
| 9,432,790 | B2 | 8/2016 | Raghuvanshi et al. |
| 9,542,952 | B2 | 1/2017 | Hatanaka et al. |
| 9,609,434 | B2 | 3/2017 | Rodigast et al. |
| 9,674,453 | B1 | 6/2017 | Tangeland et al. |
| 9,699,586 | B2 | 7/2017 | Balabanis et al. |
| 9,754,595 | B2 | 9/2017 | Lee et al. |
| 9,930,470 | B2 | 3/2018 | Reilly et al. |
| 9,937,422 | B2 | 4/2018 | Ridihalgh et al. |
| 9,941,979 | B2 | 4/2018 | Gautama et al. |
| 9,955,262 | B2 | 4/2018 | Rodigast et al. |
| 9,990,927 | B2 | 6/2018 | Lee et al. |
| 10,045,144 | B2 | 8/2018 | Ballard et al. |
| 10,063,987 | B2 | 8/2018 | McGibney |
| 10,075,791 | B2 | 9/2018 | Milne et al. |
| 10,154,361 | B2 | 12/2018 | Tammi et al. |
| 10,194,262 | B2 | 1/2019 | Kao |
| 10,200,806 | B2 | 2/2019 | Stein et al. |
| 10,225,638 | B2 | 3/2019 | Boesen et al. |
| 10,231,073 | B2 | 3/2019 | Stein et al. |
| 10,257,637 | B2 | 4/2019 | Di Censo et al. |
| 10,262,674 | B1 | 4/2019 | Wurmfeld |
| 10,292,000 | B1 | 5/2019 | Milne et al. |
| 10,293,259 | B2 | 5/2019 | Ballard et al. |
| 2003/0223602 | A1 | 12/2003 | Eichler et al. |
| 2007/0070069 | A1 | 3/2007 | Samarasekera et al. |
| 2008/0243519 | A1 | 10/2008 | Oh et al. |
| 2009/0041271 | A1 | 2/2009 | Pallone et al. |
| 2010/0215164 | A1 | 8/2010 | Sandgren et al. |
| 2010/0303266 | A1 | 12/2010 | Chen et al. |
| 2012/0002827 | A1 | 1/2012 | Oshitani |
| 2012/0035513 | A1 | 2/2012 | Afshar |
| 2012/0093320 | A1 | 4/2012 | Flaks et al. |
| 2013/0294618 | A1 | 11/2013 | Lyubachev |
| 2014/0064526 | A1 | 3/2014 | Otto et al. |
| 2015/0010169 | A1 | 1/2015 | Popova |
| 2015/0063610 | A1 | 3/2015 | Mossner |
| 2015/0223000 | A1 | 8/2015 | Bran et al. |
| 2015/0382124 | A1 | 12/2015 | Hall et al. |
| 2018/0088900 | A1 | 3/2018 | Glaser et al. |
| 2018/0096693 | A1 | 4/2018 | Gautama |
| 2018/0139566 | A1 | 5/2018 | Crum |
| 2018/0176680 | A1 | 6/2018 | Knight et al. |
| 2018/0203663 | A1 | 7/2018 | Lehtiniemi et al. |
| 2018/0213345 | A1 | 7/2018 | Mate et al. |
| 2018/0262968 | A1* | 9/2018 | Jantunen ..... H04W 40/20 |
| 2018/0286416 | A1 | 10/2018 | Lee et al. |
| 2018/0295463 | A1 | 10/2018 | Eronen et al. |
| 2018/0310114 | A1 | 10/2018 | Eronen et al. |
| 2018/0343534 | A1 | 11/2018 | Norris et al. |
| 2018/0367938 | A1 | 12/2018 | McGibney |
| 2019/0069111 | A1 | 2/2019 | Tammi et al. |
| 2019/0075418 | A1 | 3/2019 | Shi et al. |
| 2019/0116452 | A1 | 4/2019 | Shi et al. |
| 2020/0103486 | A1* | 4/2020 | Knaappila ..... G01S 5/04 |

* cited by examiner

--PRIOR ART--

--PRIOR ART--

DIRECTIONAL AWARENESS AUDIO COMMUNICATIONS SYSTEM

CROSS-REFERENCE TO RELATED APPLICATIONS/INCORPORATION BY REFERENCE

The present application claims priority under 35 U.S.C. § 119(e) to provisional application Ser. No. 62/750,007 filed on Oct. 24, 2018, entitled "DIRECTIONAL AWARENESS AUDIO COMMUNICATIONS SYSTEM," provisional application Ser. No. 62/852,452 filed on May 24, 2019, entitled "DIRECTIONAL AWARENESS AUDIO COMMUNICATIONS SYSTEM," and provisional application Ser. No. 62/876,479 filed on Jul. 19, 2019, entitled "AUDIO COMMUNICATIONS SYSTEM WITH DIRECTIONAL HAPTIC FEEDBACK." Each of the above referenced provisional applications is hereby incorporated herein by reference in its entirety.

FIELD

Certain embodiments relate to the audio communications systems. More specifically, certain embodiments relate to a directional awareness audio communications system configured to extract and utilize speaker location data to process incoming speaker audio to spatially position the audio in 3D space in a manner that provides the listener(s) with the perception that the audio is coming from a relative "geographical" direction of the remote speaker. Various embodiments relate to audio communications systems equipped with purpose-built circuitry, software, and head-gear or body-worn devices configured to utilize speaker location data to provide the listener(s) utilizing a head or body-worn device with a tactile sensation that corresponds to the direction of the speaker relative to the listener. Aspects of the present disclosure relate to audio communications systems equipped with purpose-built circuitry, software and head-gear or other handheld or body-worn device configured to utilize speaker location data to provide the listener(s) utilizing a head, body, handheld, or stationary device with a visual prompt that corresponds to the direction of the speaker relative to the listener.

BACKGROUND

In natural communications situations where both a speaker and listener are in close proximity to each other, the listener is able to hear the audio and detect spatial audio cues to determine a general location or direction of the speaker, even in complete darkness where vision in impossible. When face-to-face communications are not possible or practical, users rely on audio communications systems to speak with each other and relay critical information.

Conventional audio voice communications systems allow the listener to hear the words and sounds spoken by the speaker but do not provide the spatial audio cues that help the listener to determine the direction or general location of the speaker. In situations where the speaker is located a long distance from the listener or in situations where there are visual obstructions that prevent the listener from seeing the speaker, the listener is unable to determine the location of the speaker (the audio source). FIG. 1 is a diagram illustrating a situation where a listener (User A) is using a typical audio communications system to communicate with a speaker (User B) as known in the art. FIG. 2 is a diagram illustrating the perception of a listener (User A) of the location of various speakers (Users B, C, D, E, F, and G) using conventional communications equipment. Referring to FIGS. 1 and 2, User A (the listener) is able to hear audio sounds and words created by Users B-G (the speaker(s)) through the conventional communications device but User A is unable to determine the direction of Users B-G relative to the location of User A because there are no spatial audio cues provided through the audio channels of the system.

Further limitations and disadvantages of conventional and traditional approaches will become apparent to one of skill in the art, through comparison of such systems with some aspects of the present disclosure as set forth in the remainder of the present application with reference to the drawings.

BRIEF SUMMARY

A directional awareness audio communication system and/or method is provided for receiving real-time location information and an audio signal from a speaker device and performing audio processing on the received audio signal at a listening device based on the real-time location information relative to the listener device location and orientation, the processed audio signal provided to a user of the listener device via speaker(s), substantially as shown in and/or described in connection with at least one of the figures, as set forth more completely in the claims.

In various embodiments, an audio communication system and/or method with directional haptic feedback is provided for receiving and processing real-time geospatial location information to actuate one or more haptic devices embedded within equipment worn by a listener to create a physical sensation on a specific part of the body of the listener each time the listener receives an audio communication from a remote speaker, where the location of the sensation corresponds to the direction of the speaker relative to the listener to allow the listener to feel and/or otherwise perceive the spatial direction of each speaker voice transmission, substantially as shown in and/or described in connection with at least one of the figures, as set forth more completely in the claims.

In certain embodiments, an audio communication system and/or method with directional visual feedback is provided for receiving and processing real-time geospatial location information to present a visual directional indicator at equipment worn, held, or otherwise used by a listener to visually display directional information to the listener each time the listener receives an audio communication from a remote speaker, where the location of the visual directional indicator on a display device corresponds to the direction of the speaker relative to the listener to allow the listener to visualize the spatial direction of each speaker voice transmission, substantially as shown in and/or described in connection with at least one of the figures, as set forth more completely in the claims.

These and other advantages, aspects and novel features of the present disclosure, as well as details of an illustrated embodiment thereof, will be more fully understood from the following description and drawings.

DETAILED DESCRIPTION

Figure 1:
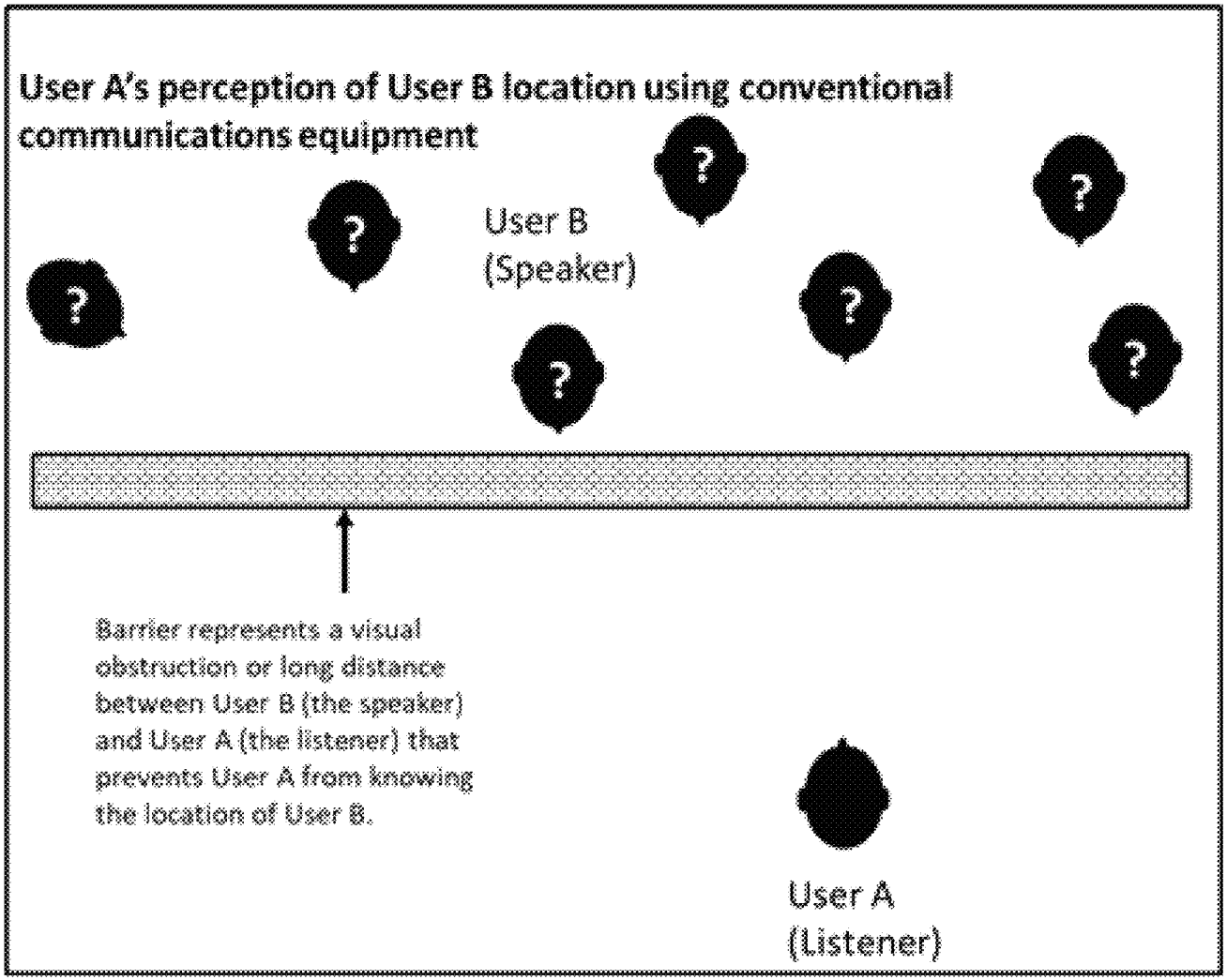
FIG. 1 is a diagram of the perception by a listener of a location of a speaker using conventional communications equipment as known in the art.
Figure 2:
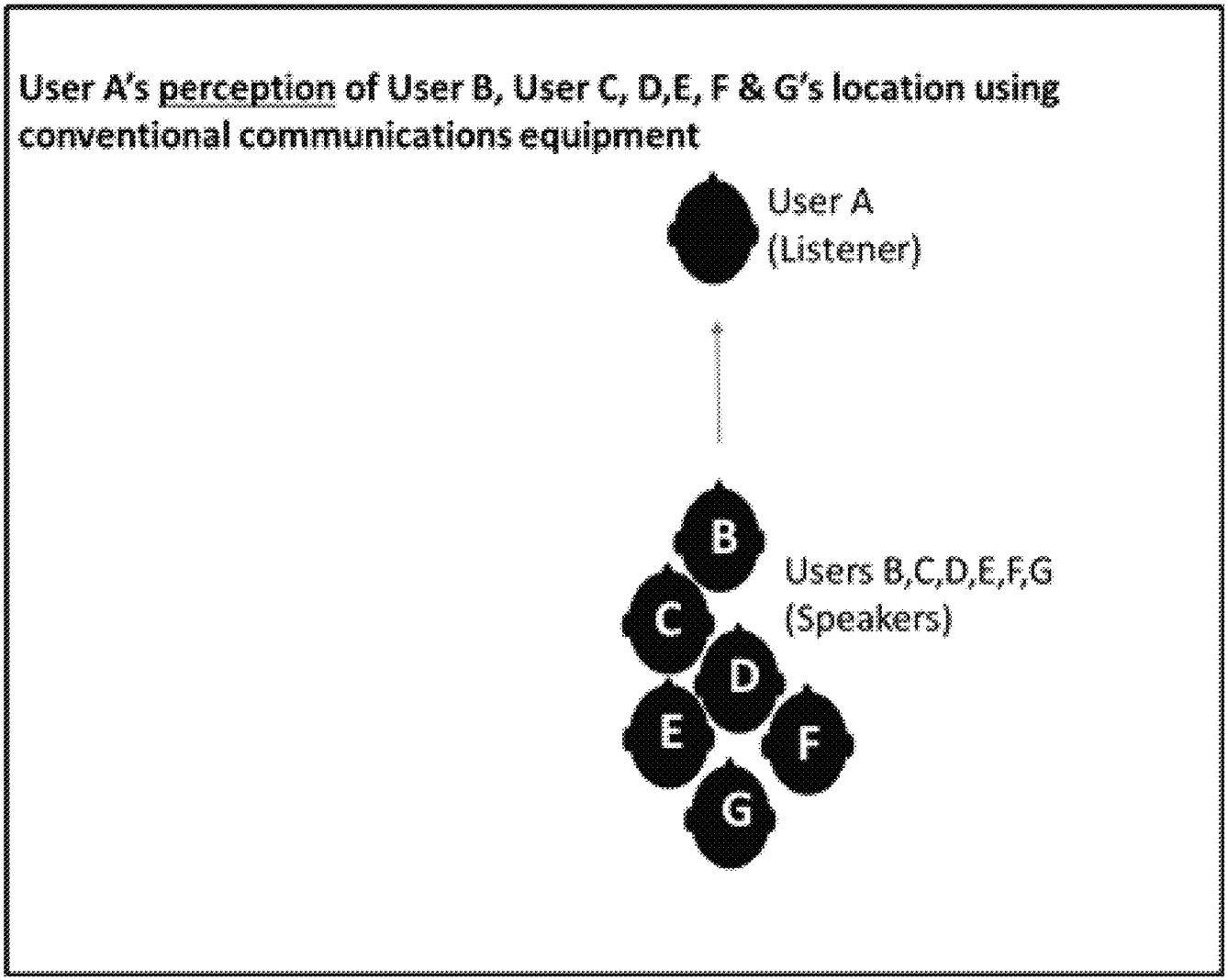
FIG. 2 is a diagram of the perception by a listener of locations of multiple speakers using conventional communications equipment as known in the art.

Certain embodiments may be found in systems, methods, and devices configured to provide a communications system such as a two-way radio, intercom, mobile phone, or other voice communications device. The communications system is configured to identify real-time location data of a speaker device, acquired through the use of a Global Navigation Satellite System (GNSS), BLE Beacon, WiFi Access Point, Altimeter, Inertial navigation system (INS), or other suitable location identification technology. The location data is transmitted in real-time along with speaker audio, either embedded with the audio, or transmitted on a separate channel, to one or multiple receivers ("listeners") on the communication system. The one or more receivers may be equipped with purpose-built circuitry and software configured to extract and utilize the speaker location data to process the incoming speaker audio to spatially position the audio in 3D space in a manner that provides the listener(s) with the perception that the audio is coming from a relative "geographical" direction of the remote speaker, even if the remote speaker is visually obstructed or many miles away. The spatial positioning of the audio takes into account the real time location data of the receiver, acquired through the use of a Global Navigation Satellite System (GNSS), BLE Beacon, WiFi Access Point, Altimeter, Inertial navigation system (INS), or other suitable location identification technology, as well as the bearing of the receiver, established by a head orientation of the listener.

Various embodiments may be found in systems, methods, and devices configured to provide a communications system configured to identify real-time location data of a speaker device. The location data is transmitted in real-time along with speaker audio, either embedded with the audio, or transmitted on a separate channel, to one or multiple receivers ("listeners") on the communication system. The one or more receivers may be equipped with purpose-built circuitry, software and head-gear or body-worn devices configured to utilize the speaker location data to provide the listener utilizing a head or body-worn device with a tactile sensation that corresponds to the direction of the speaker relative to the listener. The receivers provide the listener with the perception that the audio is coming from the relative "geographical" direction of the remote user, even if the remote user is visually obstructed or many miles away. The spatial positioning of the audio takes into account the real time location data of the receiver, acquired through the use of a Global Navigation Satellite System (GNSS), BLE Beacon, WiFi Access Point, Altimeter, Inertial navigation system (INS), or other suitable location identification technology, as well as the bearing of the receiver, established by a head orientation of the listener.

Aspects of the present disclosure may provide systems, methods, and devices configured to provide a communications system configured to identify real-time location data of a speaker device. The location data is transmitted in real-time along with speaker audio, either embedded with the audio, or transmitted on a separate channel, to one or multiple receivers ("listeners") on the communication system. The one or more receivers may be equipped with purpose-built circuitry, software and head-gear or other handheld or body-worn device configured to utilize the speaker location data to provide the listener(s) utilizing a head, body, handheld, or stationary device with a visual prompt that corresponds to the direction of the speaker relative to the listener. The head, body, handheld, or stationary device utilized by the listener allows the listener to visually determine that the audio is coming from the relative "geographical" direction of the remote user, even if the remote user is visually obstructed or many miles away. The spatial positioning of the audio takes into account the real time location data of the receiver, acquired through the use of a Global Navigation Satellite System (GNSS), BLE Beacon, WiFi Access Point, Altimeter, Inertial navigation system (INS), or other suitable location identification technology, as well as the bearing of the receiver, established by a head orientation of the listener.

Various embodiments provide the processed audio feedback, haptic feedback, and/or visual feedback, alone or in any combination, to provide the listener with the perception that the audio is coming from the relative "geographical" direction of the remote user.

Aspects of the present disclosure are directed to a direction awareness audio communications system that allows users of audio communication devices to easily hear, feel, and/or visualize (identify) the direction of other remote or potentially visually-obstructed users that are speaking. The system may use audio communications devices that utilize real-time geospatial location data and 3D or volume sound processing algorithms to create a spatial audio soundscape that allows the receiver (listener) to perceive the spatial direction of each transmitter (speaker) voice transmission in 3D space. 3D sound processing techniques utilize head-related transfer function (or HRTF) filters to mimic natural sound waves, tricking the brain to perceive the direction of incoming sound as though it was emanating from a point in 3D space even though it is often being produced from two or more speakers. Volume sound processing algorithms utilize volume adjustments in the left and/or right speakers of a listener headset or other device to provide a listener with a directional perspective of a location of the speaker. Additionally and/or alternatively, the sound processing algorithms may provide an audible sound, such as a beep or a tone, during an audio transmission where the beep or tone is spatially positioned based on the location of the speaker relative to a head orientation of the listener.

Additionally and/or alternatively, the system may use audio communications devices with embedded haptic devices that utilize real-time geospatial location data and data processing technology to actuate one or more haptic devices embedded within equipment worn by the receiver (listener). The one or more haptic devices create a physical sensation on a specific part of the body of the listener each time the listener device receives an audio communication from a remote speaker. The location of the sensation corresponds to the direction of the speaker relative to the receiver (listener), allowing the receiver (listener) to feel and therefore perceive the spatial direction of each speaker voice transmission.

Additionally and/or alternatively, the system may use audio communications devices integrated or communicatively coupled with head-gear, body-worn devices, handheld devices or stationary devices that include a visual display that provides the listener(s) with a directional visual indicator to indicate the direction of the remote speaker relative to the position of the listener while that speaker is communicating. In addition to providing a direction indicator of the speaker relative to the listener, the visual display may provide the listener with other information such as a distance, altitude, speaker name or identifier, and/or any suitable information to assist a listener in identifying the source and location of the audio.

Various embodiments may be implemented, for example, in a combat situation where the ability to determine the difference between friend and foe may mean life or death, and the ability to quickly determine where other soldiers are could be lifesaving.

The foregoing summary, as well as the following detailed description of certain embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block of random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings. It should also be understood that the embodiments may be combined, or that other embodiments may be utilized and that structural, logical and electrical changes may be made without departing from the scope of the various embodiments of the present disclosure. The following detailed description is, therefore, not to be taken in a limiting sense, and the scope of the present disclosure is defined by the appended claims and their equivalents.

As used herein, an element or step recited in the singular and proceeded with the word "a" or "an" should be understood as not excluding plural of said elements or steps, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Furthermore, the term controller, processor, or processing unit, as used herein, refers to any type of processing unit that can carry out the required calculations needed for the disclosure, such as single or multi-core: CPU, DSP, FPGA, ASIC or a combination thereof.

The direction awareness system accommodates an unlimited number of users wearing a specially designed "location awareness" stereo headset or other "location awareness" audio device to automatically broadcast the device location to all other users on the communications network wearing similar "location awareness" stereo headsets or "location awareness" audio devices. Each "location awareness" stereo headset is both a transmit and receive device or system, however, the system can include devices that can be transmitter-only or receive-only. Transmitter-only devices may be configured to transmit geospatial data in addition to audio voice communications. Receive-only devices may be configured to receive both audio voice communications and geospatial data. The geospatial data is processed to allow the user to hear, feel, and/or visualize the direction of the audio voice communications relative to the geospatial location and head orientation associated with the receive device.

Audio Feedback

Figure 3:
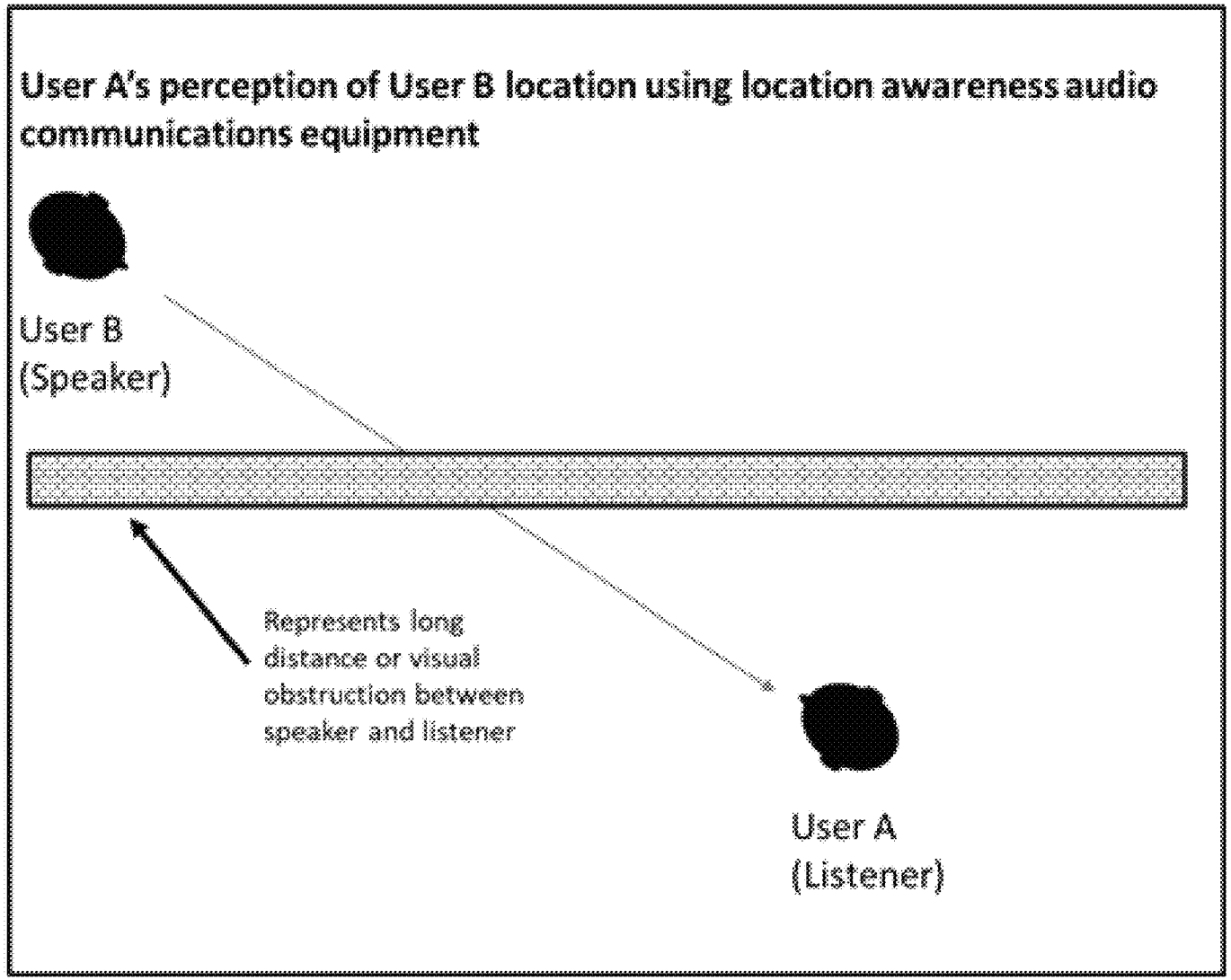
FIG. 3 is a diagram of the perception by a listener of a location of a speaker using directional awareness audio communications equipment, haptic feedback, and/or visual feedback, in accordance with various embodiments.
Figure 4:
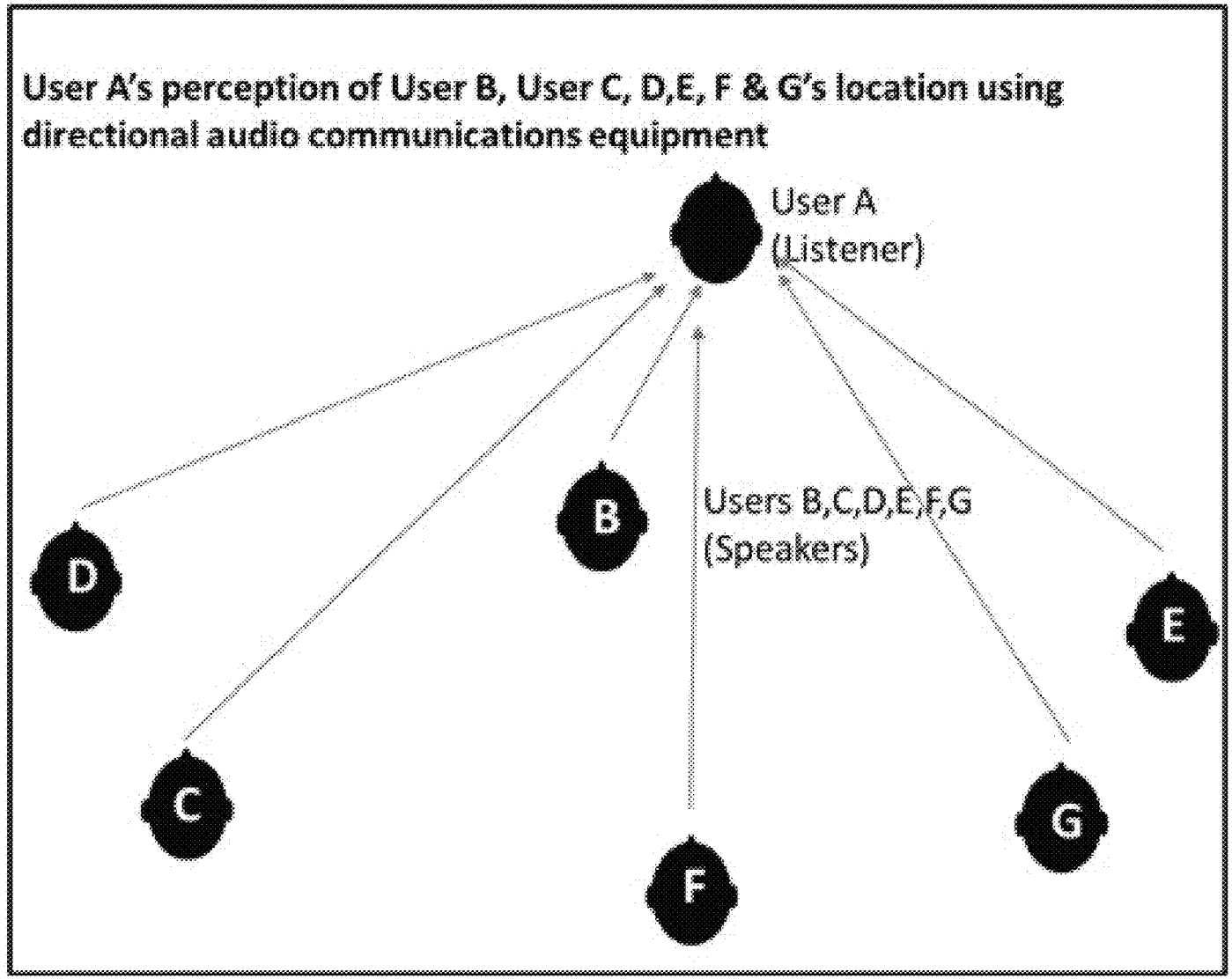
FIG. 4 is a diagram of the perception by a listener of locations of multiple speaker using directional awareness audio communications equipment, haptic feedback, and/or visual feedback, in accordance with various embodiments.

Certain embodiments provide a method by which an artificial 3D soundscape is created for the listener where local 3D Audio is steered (positioned) automatically and in real-time via remote location coordinates accompanying individual audio transmissions. The listener perceives the source of the sound as if it was originating from the direction and location of the source relative to the listener. FIG. 3 is a diagram of the perception by a listener of a location of a speaker using directional awareness audio communications equipment, in accordance with various embodiments. FIG. 4 is a diagram of the perception by a listener of locations of multiple speaker using directional awareness audio communications equipment, in accordance with various embodiments.

The location broadcast protocol of the system correlates location data to each voice or sound transmission. For purposes of the present disclosure, location data includes longitude, latitude, and elevation coordinates. The location data may be encrypted to protect a location of the user from eavesdropping or unwanted location detection. The location data may be modulated or otherwise embedded with the audio signal and sent over the audio channel of the communications device (radio, mobile phone, intercom, etc.). The location data may be sent via a data channel of the communication device if such channel exists or is accessible. The location data may be sent via a secondary device or method.

The brain utilizes subtle differences in intensity, spectral, and timing cues to allow us to localize sound sources. For example, sound coming from a speaker that was positioned to the left of a person's head would reach the left ear faster and be louder than the sound that reaches the right ear. The brain compares these differences and then determines where the source of the sound is located. Localization can be described in terms of three-dimensional position: the azimuth or horizontal angle, the elevation or vertical angle, and the distance (for static sounds) or velocity (for moving sounds).

The azimuth of a sound is signaled by the difference in arrival times between the ears, by the relative amplitude of high-frequency sounds (the shadow effect), and by the asymmetrical spectral reflections from various parts of our bodies, including torso, shoulders, and pinnae. The distance cues may include the loss of amplitude, the loss of high frequencies, and the ratio of the direct signal to the reverberated signal. Depending on where the source is located, the head acts as a barrier to change the timbre, intensity, and spectral qualities of the sound, helping the brain orient where the sound emanated from. These minute differences between the two ears are known as interaural cues.

With the 3-axis digital compass in the location awareness headset or device, a user may turn their head left or right or look up or down and the perceived audio direction automatically compensates for the rotation. The perceived audio still emanates from a fixed direction in space corresponding to the location coordinates of the person speaking. The spatial effect is similar to turning your head while listening to a person standing in a fixed location in the same room or nearby. As an example, if the voice from the remote user is perceived to be directly in front of a user's face, if the user rotates their head to the left by 90 degrees, the voice from the same remote user (provided the user does not move) is then perceived to be coming from the right.

The system accommodates many-to-one communication and is not limited to a point-to-point application. However, the following exemplary embodiment describes how the directional information is communicated between a particular user (User A) and a remote user (User B). A user (User A) receives audible directional information from incoming mono or stereo audio that is processed into 3D spatial stereo audio using 3D spatial audio techniques. The 3D spatial audio processing allows User A to perceive the audio (voice or sound source) coming from a specific direction. The direction of the perceived sound audibly informs User A of the relative orientation/direction where a remote talker/device (User B) is located. The relative volume of the voice or sound can also be adjusted to inform users of distance as well as direction (e.g., louder=near, softer=far). This directional information is particularly beneficial in situations where users are separated by distance or without the benefit of visual contact. Various embodiments are predicated on the ability for User A to establish his/her own GPS (or BLE Beacon, WiFi Access Point, or other suitable location identification technology) location, altitude, and compass coordinates and that the remote talker/device (User B) is able to broadcast its GPS (or BLE Beacon, WiFi Access Point, or other suitable location identification technology) location and altitude during audio transmissions or at regular time intervals. User A receives User B's location information and computes the direction to User B in relation to User A's geographic position. The information allows User A to assess in real time the orientation and any subsequent movement of User B. Accordingly, User B's movement is audibly communicated to User A via corresponding changes in the perceived direction and intensity of the audio (sound) in 3D space.

Certain embodiments provide a safety feature for users of portable communication devices by giving the users greater situational awareness of their team members and allowing them to locate each other more effectively without visual contact or the need for users to constantly communicate locations verbally. The safety feature may be beneficial, for example, in an urban environment where there are many buildings or crowds of people, a forested area, a smoke-filled environment, or any situation where the users may be visually obstructed from one another.

Another benefit is to improve the efficiency and effectiveness of users of mobile audio voice communication devices and the communications network itself. Using 3D spatial audio positioning to communicate directional information reduces the time and effort of verbally communicating and interpreting location/coordinates by both the sender and recipient, thereby freeing up the users to better focus on mission critical activities. Less verbal communication has the added benefit of reducing audio traffic on critical communication networks.

In various embodiments, anywhere from two to an unlimited number of users are wearing specially designed "location awareness" stereo headsets, earphones, or other audio device (connected into a communication device) incorporated with a GPS (or BLE Beacon, WiFi Access Point, or other suitable location identification technology) receiver to establish global location and digital compass to establish the forward direction of the user's head in relation to the Cartesian coordinates. Each user wearing a location awareness headset broadcasts its own GPS (or BLE Beacon, WiFi Access Point, or other suitable location identification technology) location data to all users in the (wired or wireless) network so that all the other users wearing the same location awareness headsets are aware of each other's locations. The location data may be transmitted at the same time as the speaker's voice, thereby allowing each receiving "location awareness" headset or suitable audio device to process the incoming data and, through audio processing, synthesize a perceived direction to the audio communications heard by the receiving headset.

The headset to headset location data communication protocol can be superimposed onto (added into) any existing wired or wireless audio communication protocol/system including Land Mobile Radios ("Half-duplex PTT communication systems), Full Duplex wired or wireless Intercoms, Cellphones, Wired POTS phone, VOIP, Bluetooth, etc. The headset to headset location data communication protocol is intended to produce little to no degradation to the audio intelligibility, particularly to the users on the communication system that do not have the location awareness headsets or audio communications devices. In systems where a dedicated data channel is provided, the location data communication protocol can be sent via a digital data channel.

Although various embodiments describe the technology embedded into stereo headsets, the technology may be implemented into primary communications devices such as Land Mobile Radios, Cellphones, Wireless intercoms, etc. and additionally and/or alternatively into audio accessories that attach onto those communication devices including, for example, "Remote Speaker Microphones" (RSMs), Fireman Self-contained breathing apparatus (SCBA) Masks, Bluetooth headsets and earbuds, or dongle-type accessory attachments for Land Mobile Radio or Cellphones, protective helmets, eye protection devices and glasses, communications system base stations, vehicles, aircraft control towers, command centers (e.g., 911 command center), and virtual reality headgear, among other things.

In certain embodiments, the users wearing the location awareness stereo headsets or audio devices, may have a body worn device with a display that communicates visually a more precise direction in addition to distance to the remote user to supplement the audible 3D audio. The display unit could be a standalone unit, or it could be an application on a smartphone linked via Bluetooth with the location awareness stereo headset.

Figure 5:
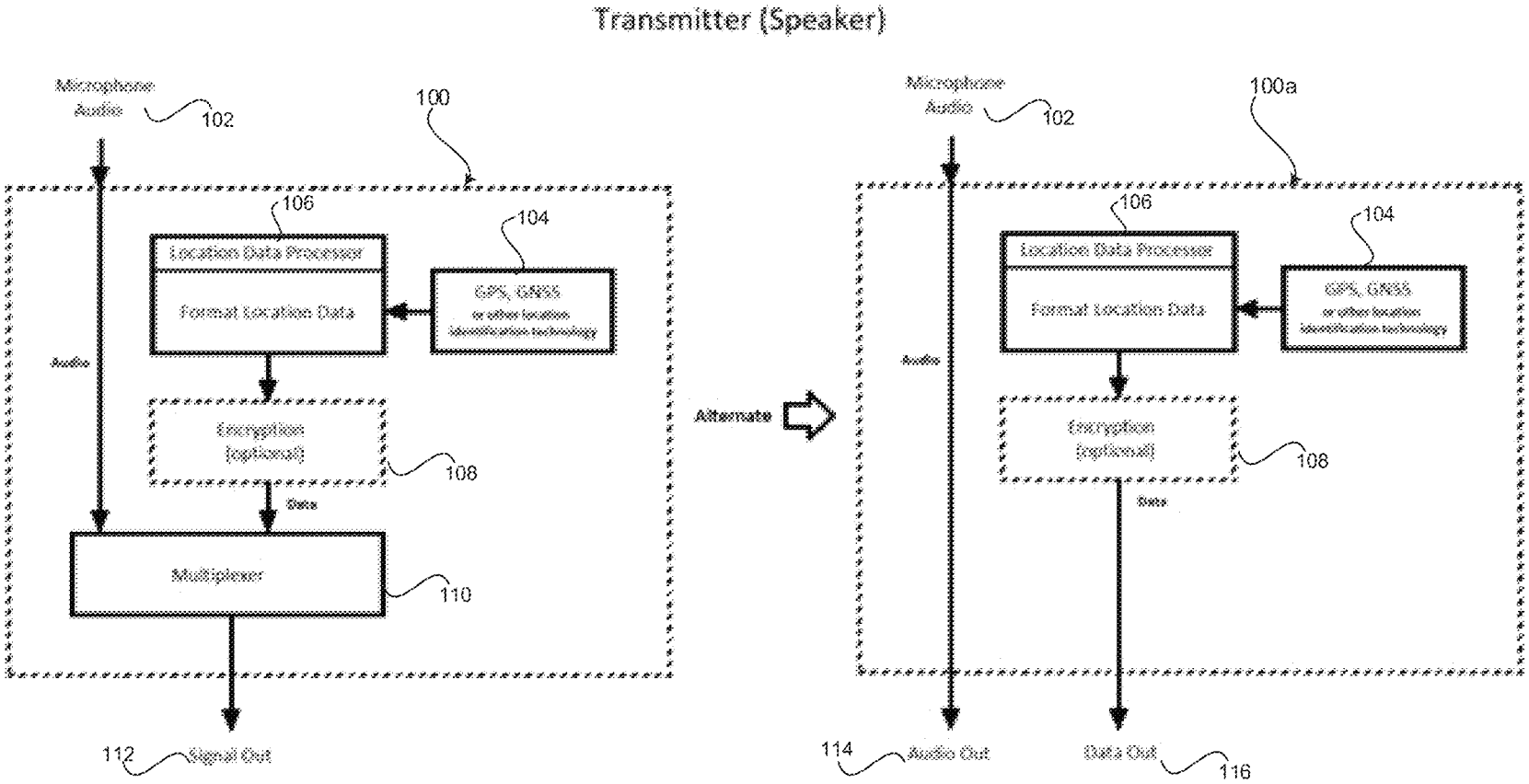
FIG. 5 is a block diagram of exemplary transmitter configurations in a directional awareness audio communications system, in accordance with various embodiments.

FIG. 5 is a block diagram of exemplary transmitter 100, 100*a* configurations in a directional awareness audio communications system, in accordance with various embodiments. Referring to FIG. 5, a transmitter 100, 100*a* may comprise suitable logic, circuitry, interfaces and/or code that may be configured to process and transmit audio and location data. The transmitter may be provided, for example, in a headset or communication device having a microphone. For example, the transmitter may be provided in a directional awareness audio communications speaker and listener device or a speaker-only device. The audio and location data may be combined 112 prior to transmission as shown by transmitter 100 or transmitted separately, such as via dedicated audio 114 and data 116 channels as shown by transmitter 100*a*. The transmitter 100, 100*a* includes a location data processor 106 that may comprise suitable logic, circuitry, interfaces and/or code that may be configured to receive and format location data associated with the location of the transmitter. For example, the location data may include a location and an altitude provided by location identification technology 104. The location may be identified by GPS, BLE Beacon, WiFi Access Point, or other suitable location identification technology 104. The location identification device 104 may be integrated with or communicatively coupled to the transmitter 100, 100*a*. The altitude may be provided by an altimeter or any suitable altitude identification device. In a representative embodiment, the location data processor 106 may comprise suitable logic, circuitry, interfaces and/or code that may be configured to monitor whether the transmitter 100, 100*a* is able to positively determine its location while transmitting the audio signal. For example, the location data processor 106 may determine that the location identification technology 104 is not receiving location data or that the received data is otherwise unreliable. The location data processor 106 may be configured to transmit a warning in place of the location data if the location data is unavailable or unreliable. In various embodiments, the formatted location data may be encrypted by the location data processor 106, an encryption processor 108, or any suitable processor. The location data may be transmitted on a data channel 116 or may be provided to a multiplexer 110 configured to combine the location data with audio data prior to transmission as a combined signal 112. In certain embodiments, the location data processor 106 and/or location identification device 104 may be omitted and/or disabled if the receiver 200, 200*a* is equipped with a Radio Direction Finding (RDF) device to determine the transmitter location as described below. Additionally and/or alternatively, the location data processor 106 and/or location identification device 104 may be used along with the RDF device of the receiver 200, 200*a*.

Figure 6:
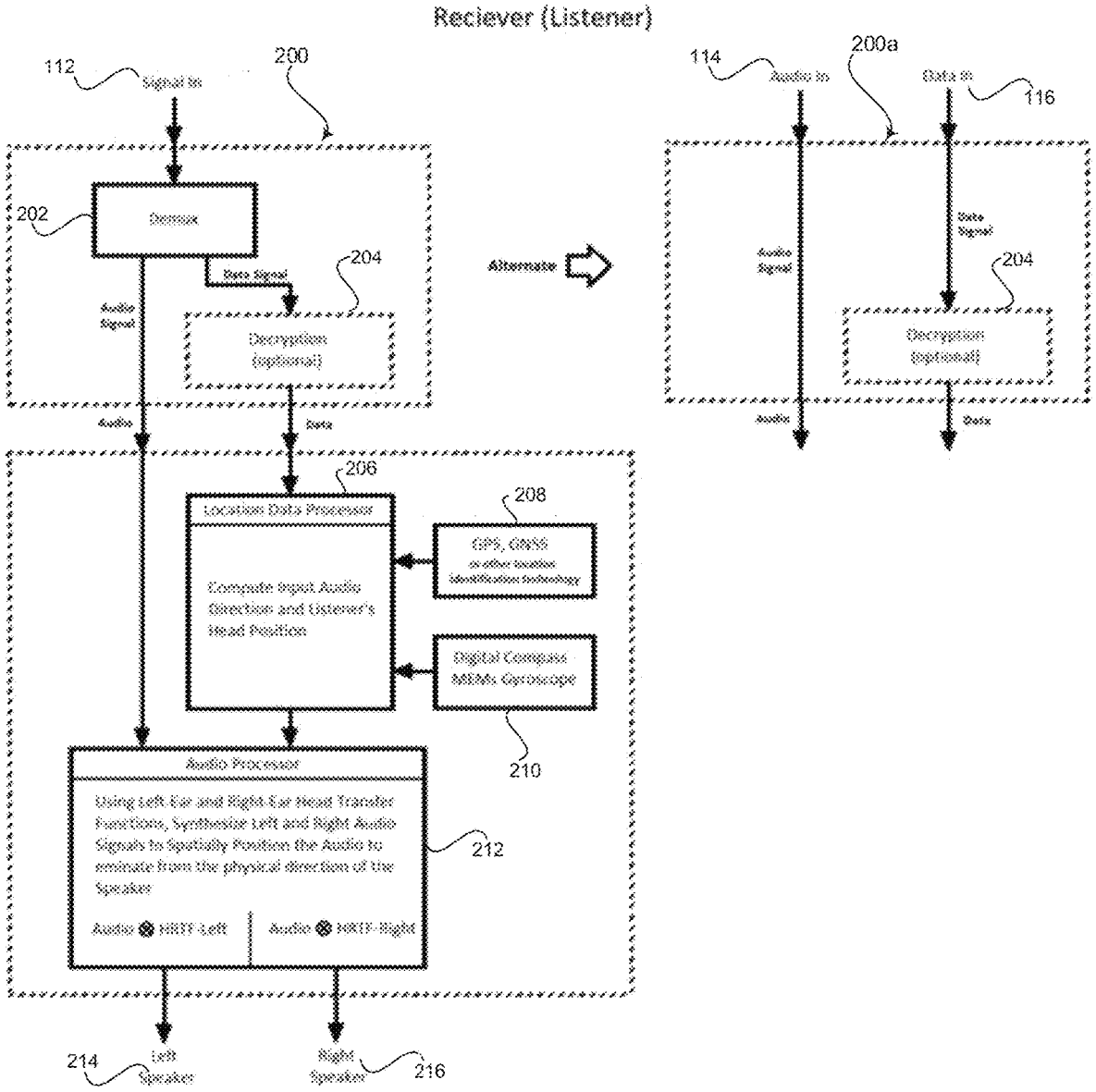
FIG. 6 is a block diagram of exemplary receiver configurations in a directional awareness audio communications system, in accordance with various embodiments.

FIG. 6 is a block diagram of exemplary receiver configurations 200, 200*a* in a directional awareness audio communications system, in accordance with various embodiments. Referring to FIG. 6, a receiver 200, 200*a* may comprise suitable logic, circuitry, interfaces and/or code that may be configured to receive and process audio and location data. The receiver 200, 200*a* may be provided, for example, in a binaural headset or a communication device having speakers 214, 216 (e.g., an auxiliary processing device such as a smart phone or laptop). For example, the receiver 200, 200*a* may be provided in a directional awareness audio communications speaker and listener device or a listener-only device. The receiver 200, 200*a* may receive the audio and location data in a composite signal 112 or separately, such as via dedicated audio 114 and data 116 channels. As an example, the receiver 200, 200*a* may include a demultiplexer 202 configured to separate audio and location data received in a composite signal 112 or may separately receive the audio 114 and location 116 data. In various embodiments, the receiver 200, 200*a* may include a decryption processor 204 configured to process encrypted location data.

In addition to or as an alternative to receiving location data 116 from the transmitter 100, 100*a*, the receiver may include a Radio Direction Finding (RDF) device comprising suitable logic, circuitry, interfaces, and/or code that may be configured to determine the location of the transmitter 100, 100*a* with respect to the receiver 200, 200*a* based on the transmitted audio signal 114. For example, the RDF device may include an RDF processor configured to compare signal strengths received by phased array antennas or mechanically rotated antennas at different locations such that the transmitted audio signal 114 from various angles may be compared to triangulate the position of the transmitter 100, 100*a*. The audio signal 114 propagates from the transmitter 100, 100*a* in a straight line. By measuring the polarization direction or phase direction of the transmitted signal 114, the RDF processor may determine the angle of the transmitted audio signal 114 relative to the receiver 200, 200*a*. For example, an RDF device antenna, such as a loop antenna, may rotate and pinpoint the direction from which the audio signal 114 is strongest, which corresponds to the direction of the transmitted signal 114. The RDF processor may utilize either polarization direction finding or phase direction finding methods to determine the direction of the transmitted audio signal 114. The RDF device may utilize directional antennas, such as rotating loop antennas, dipole antennas, loaded-loops or cross-looped antennas to measure the electromagnetic properties of the wave. Additionally and/or alternatively, the RDF device may use phase arrays or Doppler antennas to determine the source of the transmission. The RDF device may be configured to perform multiple measurements of the electromagnetic field of the transmitted audio signal 114 to determine which direction provides the strongest or weakest signal. The RDF processor may establish a directional vector based on a relative position of the receiver 200, 200*a* to the transmitter 100, 100*a*. The RDF processor may assess the RF signal strength of the audio signal 114 in 360-degrees and establish a directional vector between the transmitter 100, 100*a*, and receiver 200, 200*a* based on the direction with the strongest signal strength. In certain embodiments, the detection method may take into account RF reflections to avoid false conclusions. The RDF device may include one or a plurality of antennas. The transmit device may employ multiple frequencies with unique propagation and reflective properties to provide improved directional confidence through multiple measurements. In addition to direction, the RDF processor may assess the distance to the transmitter based on the RF signal strength of the audio signal 114. The RDF device may be integrated with or communicatively coupled to the receiver 200, 200*a*.

In an exemplary embodiment, the location data processor 206 may use the location information from the RDF device in addition or as an alternative to the location data 116. For example, the system may omit the location data signal 116 and rely instead on the RDF device of the receiver 200, 200*a*. As another example, the location data provided by the RDF device may be used if the location data signal 116 is unavailable or unreliable.

The receiver 200, 200*a* may include a location data processor 206 that may comprise suitable logic, circuitry, interfaces and/or code that may be configured to compute an input audio direction relative a location and head orientation of the receiver 200, 200*a*. The input audio direction may be provided as a vector between the transmitter 100, 100*a* and receiver 200, 200*a*. The vector may be computed, for example, based on a signal from the RDF device and a receiver orientation from the orientation detection device 210, or based on the respective locations and/or orientations of the transmitter 100, 100*a* and receiver 200, 200*a*. The location of the receiver may be identified by GPS, BLE Beacon, WiFi Access Point, or other suitable location identification technology 208. The location identification device 208 may be integrated with or communicatively coupled to the receiver 200, 200*a*. The head orientation may be identified by a digital compass and a MEMs gyroscope circuit or any suitable head orientation detection device 210. The head orientation detection device 210 may be mounted to a head of the listener to assess the direction the head is facing as well as to assess pitch, roll, and yaw of the head. The location data processor 206 may comprise suitable logic, circuitry, interfaces and/or code that may be configured to monitor whether location data 116 has been received from the transmitter 100, 100*a* and/or if the RDF device has determined a location of the transmitter 100, 100*a* with respect to the receiver 200, 200*a*. For example, the location data processor 206 may determine that the data signal 116 is missing, does not include location data, and/or includes a warning or message that the transmitter 100, 100*a* location information is unavailable or otherwise unreliable. As another example, the location data processor 206 may determine that the location information provided via an RDF device is inconclusive, such as due to RF reflections in a particular environment causing multiple directions to have similar RF power. The location data processor 206 may be configured to provide an audible or visual warning to notify the listener that the speaker and/or transmitter 100, 100*a* location is currently unavailable, unreliable, or otherwise unknown. The warning may be a haptic vibration, a tone, a beep, a message, and/or any suitable warning. For example, the warning may be a pre-recorded voice message stating that the audio signal location is based on a last known location of the speaker or that the GPS location signal of the speaker has been lost. The warning may provide critical information, for example, in situations where a listener is relying on accurate speaker location information during an audio communication.

The receiver 200, 200*a* may include an audio processor 212 that may comprise suitable logic, circuitry, interfaces and/or code that may be configured to synthesize at least left and right audio signals to spatially position the audio to emanate from the physical direction of the speaker transmitter using head transfer functions, such as left-ear and right-ear head transfer functions. Additionally and/or alternatively, the audio processor 212 may be configured to apply volume adjustments in the left and/or right speakers of a listener headset to provide a listener with a directional perspective of a location of the speaker. The volume adjustments may be based on the location of the speaker relative to a location and head orientation of the listener. Additionally and/or alternatively, the audio processor 212 may be configured to provide an audible sound, such as a beep or a tone, during an audio transmission where the beep or tone is spatially positioned based on the location of the speaker relative to a location and head orientation of the listener. The audio processor 212 may output the processed audio signals to at least two speakers, such as a left speaker 214 and a right speaker 216, among other things. In various embodiments, the audio processor 212 may output the standard mono or stereo signal provided by the transmitter 100, 100*a* to the speakers 214, 216 if the location data from the transmitter 100, 100*a* is unavailable. The standard mono or stereo signal may be provided with the warning provided by the location data processor 206 as described above.

Figure 7:
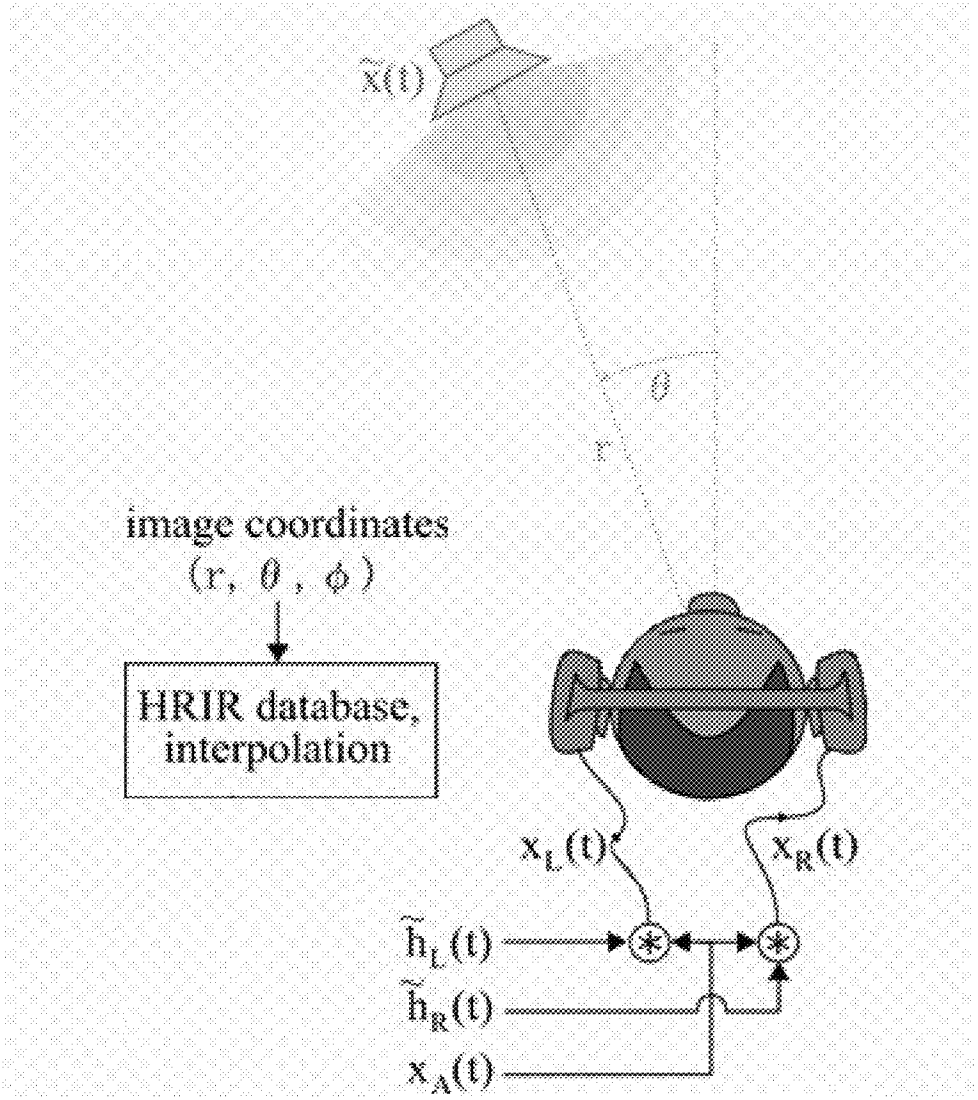
FIG. 7 is a diagram of exemplary three-dimensional (3D) audio processing performed at a receiver in a directional awareness audio communications system, in accordance with various embodiments.

FIG. 7 is a diagram of exemplary three-dimensional (3D) audio processing performed at a receiver in a directional awareness audio communications system, in accordance with various embodiments. The spatial audio processing may be self-contained within a listening device (e.g., binaural headphones). Alternatively, the audio processing can reside in an auxiliary device, for example, within a software application residing on a linked (data or audio-linked to the listening device) portable or handheld device like a smart phone, tablet, or laptop. The spatial audio processing at the listening receiver device is preceded by first establishing the direction of the incoming audio by comparing the geographical coordinates of the receiver with the geographical coordinates of the transmitter. For example, establishing coordinates may be accomplished by both receiver and transmitter devices incorporating receiver circuitry which accesses any one of a number of Global Navigation Satellite Systems (GNSS), BLE Beacon, WiFi Access Point, Altimeter, Inertial navigation system (INS), or other suitable location identification technology. The coordinates of the transmitter are then transmitted to the receiver alongside the transmitted audio (either embedded with the audio or on a dedicated data channel) using wired or wireless communication channels.

Once both the transmitter and receiver coordinates are known to the receiver, a mathematical computation may be performed to establish a directional vector from the transmitter to the receiver. The directional vector is fixed in space but may be continually offset to compensate for the rotation of the listener's head. The offset is based on the listener's forward head orientation that may be established, for example, by a digital compass for Cartesian coordinates, and a MEMS gyroscope for head roll, pitch and yaw. The audio processing may be performed to spatially position the audio to appear to come from the physical direction of the speaker once the head-orientation-compensated directional vector from the transmitter to the receiver is established. The audio processing takes incoming mono or stereo audio and converts it into 3D spatial binaural (stereo) audio to produce the desired spatial effect.

Humans can locate sounds in three dimensions—in range (distance), in direction above and below, in front and to the rear, as well as to either side. This is possible because the brain, inner ear and the external ears (pinna) work together to make inferences about location.

In various embodiments, a pair of head-related transfer function (HRTFs) unique for left and right ear are used to synthesize a binaural sound that is perceived to come from a particular point in space. The HRTFs for left and right ear describe the filtering that takes place to a sound source (x(t)) before it is perceived at the left and right ears as xL(t) and xR(t), respectively. A HRTF characterizes how an ear receives a sound from a point in space. As sound strikes the listener, the size and shape of the head, ears, ear canal, density of the head, size and shape of nasal and oral cavities, all transform the sound and affect how it is perceived, boosting some frequencies and attenuating others. All these characteristics influence how (or whether) a listener can accurately tell what direction a sound is coming from. HRTFs can vary significantly from person to person. To get the most precise spatial perception of audio, unique HRTFs would be generated for each unique user, but doing so is often not practical, so it is generally easier to implement audio spatialization using "ideal" HRTFs measured using a "dummy head" of idealized geometry.

In certain embodiments, the method used to obtain the HRTF for sound from a given source location is to measure the head-related impulse response (HRIR), h(t), at the ear drum (measured for a "dummy head" of idealized geometry) for the impulse Δ(t) placed at the source. The HRTF H(f) is the Fourier transform of the HRIR h(t). HRTF's are functions of frequency and spatial variables. HRTF, H(f, θ, φ).

Typically, sounds generated from headphones appear to the listener as if they originate from within the head. To position the audio to appear to emanate from a point in space, the headphones externalize the sound. Using a HRTF, sounds can be spatially positioned to be perceived to emanate from a point in space using the technique described below.

Assume x1(t) represents an electrical signal driving a loudspeaker producing sound from a particular direction toward a listener, and y1(t) represents the signal received by a microphone inside the listener's eardrum. Similarly, assume x2(t) represent the electrical signal driving a headphone speaker and y2(t) represents the signal received by a microphone inside the listener's ear drum. The goal of spatial audio positioning is to modify x2(t) such that y2(t) =y1(t).

Applying Fourier transforms to these signals provides the following two equations:

$$Y1=X1LFM, \text{ and } Y2=X2HM$$

where:

L is the transfer function of the loudspeaker,

F is the HRTF,

M is the microphone transfer function,

H is the headphone-to-eardrum transfer function.

Setting Y1=Y2, and solving for X2 yields $$X2=X1LF/H.$$

Therefore, the desired transfer function is:

$$T=LF/H.$$

If x1(t) is passed through this filter and the resulting x2(t) is played on the headphones, it produces the same signal at the eardrum. Since the filter applies only to a single ear, another filter is derived for the other ear. This process is repeated for many places in the virtual environment to create an array of head-related transfer functions for each position to be recreated.

Figure 8:
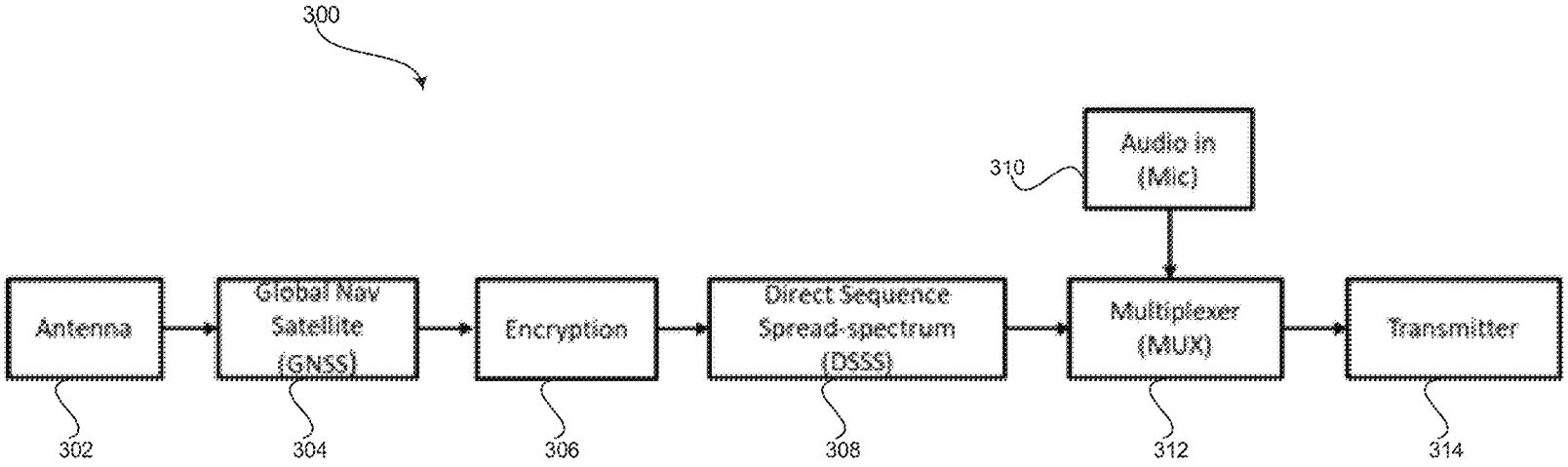
FIG. 8 is a block diagram of an exemplary transmitter in a directional awareness audio communications system, in accordance with various embodiments.

FIG. 8 is a block diagram of an exemplary transmitter 300 in a directional awareness audio communications system, in accordance with various embodiments. Referring to FIG. 8, a system architecture for an encrypted transmitter 300 where location data is embedded with audio may comprise suitable logic, circuitry, interfaces and/or code that may be configured to receive location data and audio, process the received location data and audio into a composite signal, and transmit the composite signal. The transmitter may comprise an antenna 302, a global navigation satellite system (GNSS) receiver 304, an encryption processor 306, a direct sequence spread spectrum (DSSS) processor 308, a microphone 310, a multiplexer 312, and a transmitter 314. The antenna 302 may be configured to receive location signals, such as Global Navigation Satellite Systems (GNSS) signals, BLE Beacon signals, WiFi Access Point signals, Altimeter signals, Inertial navigation system (INS) signals, or the like. The GNSS receiver 304 may comprise suitable logic, circuitry, interfaces and/or code that may be configured to receive GNSS signals from the antenna 302 and digitally process the signals from a GNSS satellite constellation to provide position, velocity, and time of the receiver 304. In various embodiments, the receiver 304 may include additional and/or alternative receivers configured to process the signals received at antenna 302. For example, the receiver 304 may include additional and/or alternative receivers configured to process BLE Beacon signals, WiFi Access Point signals, Altimeter signals, Inertial navigation system (INS) signals, or the like. The encryption processor 306 may comprise suitable logic, circuitry, interfaces and/or code that may be configured to encrypt the processed location data signal provided by the receiver 304 to protect the location of the transmitter from eavesdropping or unwanted location detection. The DSSS processor 308 may comprise suitable logic, circuitry, interfaces and/or code that may be configured to apply direct sequence spread spectrum modulation algorithms to the encrypted location data signal to reduce signal interference. The modulated location data signal output from the DSSS processor 308 may be provided to multiplexer 312. The microphone 310 may be configured to convert sound into an electrical audio signal that is provided to multiplexer 312. The multiplexer 312 may comprise suitable logic, circuitry, interfaces and/or code that may be configured to combine the location data signal from the DNSS processor 308 with the audio signal from the microphone 310 into a single output signal that is provided to transmitter 314. The transmitter 314 may comprise suitable logic, circuitry, interfaces and/or code that may be configured to wirelessly transmit the single output signal received from the multiplexer 312 to one or more receivers, such as the receiver 400 described below with respect to FIG. 9.

Figure 9:
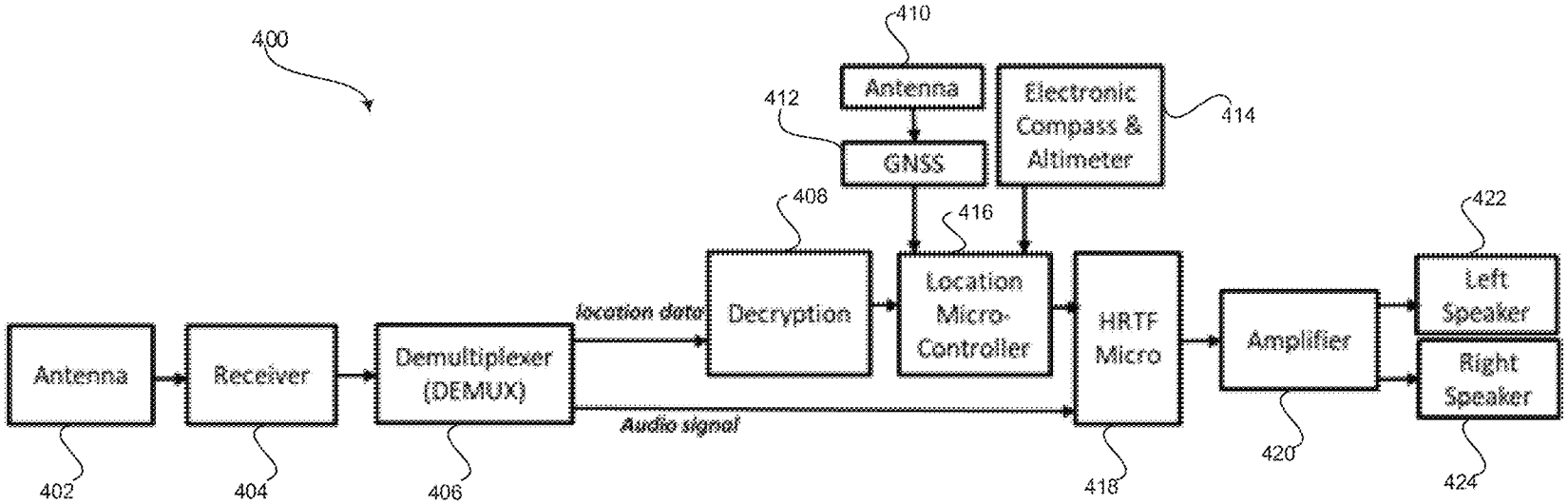
FIG. 9 is a block diagram of an exemplary receiver in a directional awareness audio communications system, in accordance with various embodiments.

FIG. 9 is a block diagram of an exemplary receiver 400 in a directional awareness audio communications system, in accordance with various embodiments. Referring to FIG. 9, a system architecture for a receiver 400 (using signal encryption) for a headset where embedded location data is extracted from audio may comprise suitable logic, circuitry, interfaces and/or code that may be configured to receive and separate transmitter location data from audio, process the received transmitter location data with respect to received receiver location data to determine a directional vector from the transmitter to the receiver, and process the audio based on the directional vector to convert the incoming mono or stereo audio to 3D spatial stereo audio that it output at two or more speakers 422, 424. The receiver 400 may comprise an antenna 402, receiver 404, demultiplexer 406, decryption processor 408, antenna 410, GNSS receiver 412, electronic compass and altimeter 414, location micro-controller 416, HRTF micro-controller 418, amplifier 420, and speakers 422, 424. The antenna 402 may be configured to receive wireless signals, such as the radio waves providing the composite signal transmitted from the transmitter 300 of FIG. 8. The receiver 404 may comprise suitable logic, circuitry, interfaces and/or code that may be configured to convert the radio waves received by the antenna 402 to an electrical composite signal that is provided to the demultiplexer 406. The demultiplexer 406 may comprise suitable logic, circuitry, interfaces and/or code that may be configured to separate the location data signal and the audio signal from the composite signal provided by the receiver 404. The demultiplexer 406 may provide the location data signal to the decryption processor 408 and may provide the audio signal to the HRTF micro-controller 418. The decryption processor 408 may comprise suitable logic, circuitry, interfaces and/or code that may be configured to decrypt the location data signal provided by the demultiplexer 406. The decryption processor 408 may apply decryption algorithms that correspond to the encryption algorithms applied by the encryption processor 306 of the transmitter 300 as described above with respect to FIG. 8. The decrypted location data signal is provided to the location micro-controller 416. As described above with respect to FIG. 6, the receiver 400 may include an RDF device in addition to or as an alternative to the antenna 402, receiver 404, demultiplexer 406, decryption processor 408, antenna 410, and GNSS receiver 412. The RDF device may be configured to ascertain the location of the transmitter 300 with respect to the receiver 400 based on the direction of the received audio signal.

Referring again to FIG. 9, antenna 410 may be configured to receive location signals, such as Global Navigation Satellite Systems (GNSS) signals, BLE Beacon signals, WiFi Access Point signals, Altimeter signals, Inertial navigation system (INS) signals, or the like. The GNSS receiver 412 may comprise suitable logic, circuitry, interfaces and/or code that may be configured to receive GNSS signals from the antenna 410 and digitally process the signals from a GNSS satellite constellation to provide position, velocity, and time of the receiver 412. In various embodiments, the receiver 412 may include additional and/or alternative receivers configured to process the signals received at antenna 410. For example, the receiver 412 may include additional and/or alternative receivers configured to process BLE Beacon signals, WiFi Access Point signals, Altimeter signals, Inertial navigation system (INS) signals, or the like. The processed signals identifying the location of the receiver 412 are provided to the location micro-controller 416. The electronic compass and altimeter 414 may comprise suitable logic, circuitry, interfaces and/or code that may be configured to measure magnetic fields, atmospheric pressures, and/or any suitable characteristics to provide signals identifying a direction and altitude of a head of a user. The directional and altitude signals may be provided to the location micro-controller 416. The location micro-controller 416 may comprise suitable logic, circuitry, interfaces and/or code that may be configured to generate a directional vector between the transmitter 300 of FIG. 8 and the receiver 400 of FIG. 9 based on the location data of the transmitter 300 received from the decryption processor 408, the location data of the receiver 400 received from the GNSS processor 412, and the altitude data and a head orientation of a user of the receiver 400 received from the electronic compass and altimeter 414. The directional vector generated by the location micro-controller 416 may be provided to the HRTF micro-controller 418. Additionally and/or alternatively, the location micro-controller 416 may generate the directional vector based on the location information of the transmitter 300 with respect to the receiver 400 provided by an RDF device and the head orientation of a user of the receiver 400 provided by the electronic compass and altimeter 414. The HRTF micro-controller 418 may comprise suitable logic, circuitry, interfaces and/or code that may be configured to process the audio signal received from the demultiplexer 406 based on the directional vector received from the location micro-controller 416 to convert the incoming mono or stereo audio to 3D spatial stereo audio that is provided to an amplifier 420 prior to being output at two or more speakers 422, 424. The amplifier 420 may comprise suitable logic, circuitry, interfaces and/or code that may be configured to amplify the stereo audio signal provided by the HRTF micro-controller 418. The speakers 422, 424 may be configured to convert the amplified stereo audio signal received from the amplifier 420 to sound.

Figure 10:
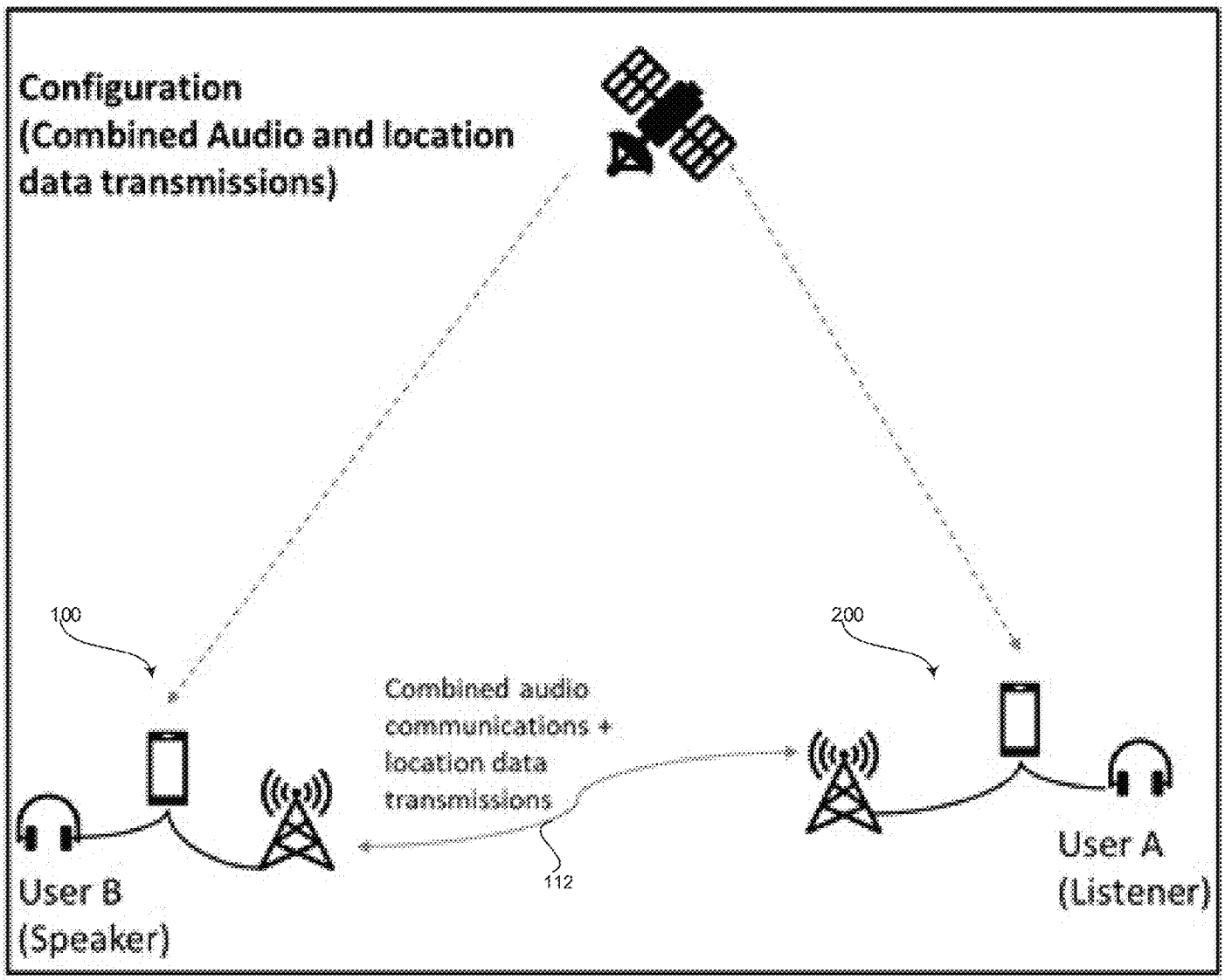
FIG. 10 is a diagram of an exemplary configuration of a directional awareness audio communications system that combines audio and location data transmissions, in accordance with various embodiments.
Figure 11:
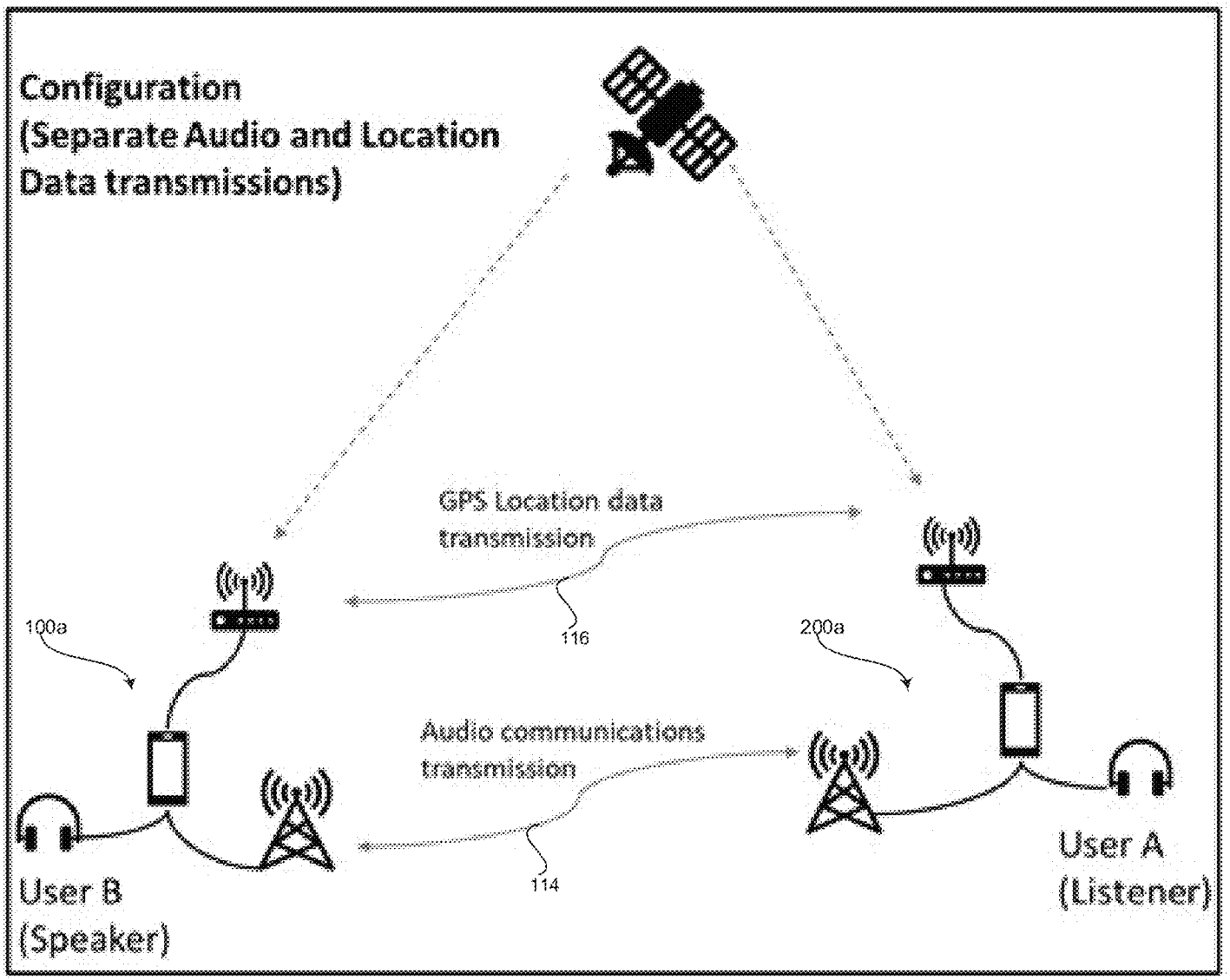
FIG. 11 is a diagram of an exemplary configuration of a directional awareness audio communications system that provides separate audio and location data transmissions, in accordance with various embodiments.

FIG. 10 is a diagram of an exemplary configuration of a directional awareness audio communications system that combines audio and location data transmissions, in accordance with various embodiments. The system of FIG. 10 may share various characteristics with the transmitters 100, 300 of FIGS. 5 and 8 and the receivers 200, 400 of FIGS. 6 and 9, for example. FIG. 11 is a diagram of an exemplary configuration of a directional awareness audio communications system that provides separate audio and location data transmissions, in accordance with various embodiments. The system of FIG. 11 may share various characteristics with the transmitter 100*a* of FIG. 5 and the receiver 200*a* of FIG. 6, for example.

Haptic Feedback

Certain embodiments provide a system and method by which an artificial sensation is created for the listener where specific haptic engines that correspond to the geographic direction of the audio source turn on automatically and in real time via remote location coordinates accompanying individual audio transmissions. The listener feels a directional sensation and perceives the source of the sound as if it was originating from the direction and location of the source relative to the listener. FIG. 3 is a diagram of the perception by a listener of a location of a speaker using audio communications equipment with directional haptic feedback, in accordance with various embodiments. FIG. 4 is a diagram of the perception by a listener of locations of multiple speaker using audio communications equipment with directional haptic feedback, in accordance with various embodiments.

The head-gear or body-worn devices would contain multiple haptic engines, vibrating motors or other technologies that provide the user with physical sensation, as if being touched, that is emanating from the direction of the remote speaker while that speaker is communicating. The head orientation (or body orientation) of the listener would determine the listener directional orientation. As the listener rotates their head (or body) while listening to communications from the remote speaker, the haptic headband or haptic body unit would pulse the individual haptic engine that most closely corresponds to the directional location of the remote speaker. The haptic sensors on the listener head-gear or body-worn device would vibrate or pulse as the speaker starts transmitting their audio communication.

The vibration or pulsing on the listener device may be continuous during the entire inbound audio communications or it may be stop after several seconds, which would be long enough for the receiver of the audio to determine the direction of the speaker.

In various embodiments, a different vibration or pulse style is assigned to different speakers to help a listener differentiate between inbound audio sources. For example, the haptic device may pulse or vibrate only one time when the listener is receiving in-bound audio from a first speaker, designated as Speaker 1. The haptic device in the listener equipment may pulse or vibrate two times, or any suitable number of times, when the listener receives in-bound audio from a second speaker, designated as Speaker 2. Additionally and/or alternatively, the listener device may provide different vibration patterns corresponding to different audio sources.

In an exemplary embodiment, the intensity of the vibration may vary depending on distance between the speaker location and the listener location to communicate distance between the speaker and the listener. For example, the vibration may be stronger or more intense as shorter distances compared to longer distances.

The haptic device may comprise multiple haptic sensors embedded into a headband, a helmet, an audio communications headset, a virtual reality headset, a pair of glasses, or any suitable head or body worn device. As an example, the multiple haptic sensors may be embedded in a band that can be worn around the neck or chest or embedded in a vest or within clothing, among other things. Regardless of the physical structure the haptic sensors are embedded in, the haptic sensors are configured to provide the listener with a physical sensation while receiving (hearing) audio communication from a remote speaker that corresponds with the direction of the remote speaker relative to the listener.

Figure 12:
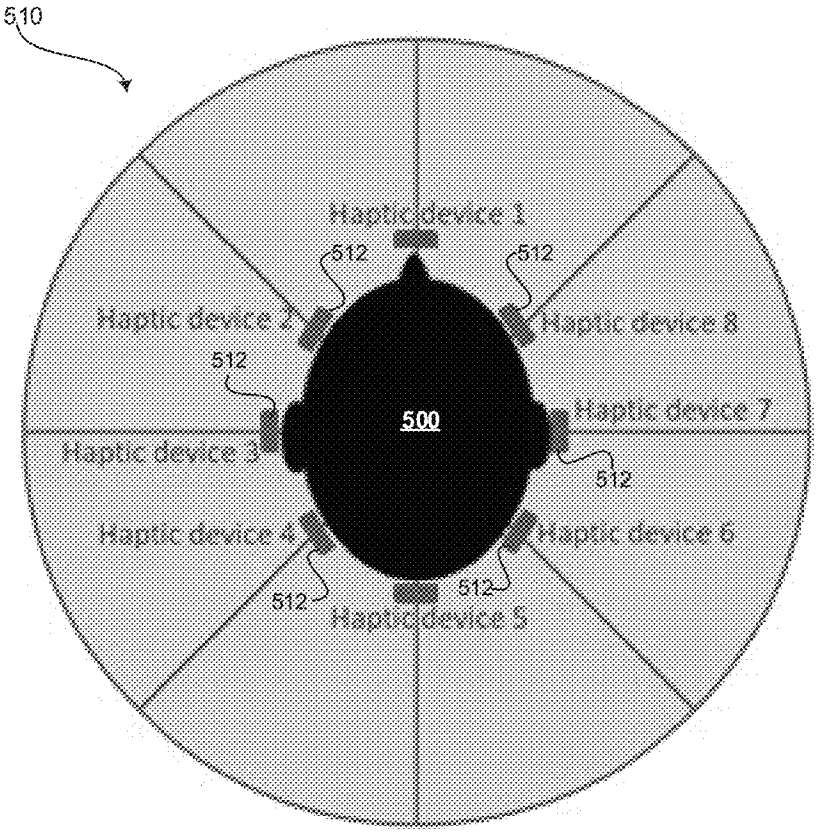
FIG. 12 is a diagram of an exemplary headband haptic device configuration, in accordance with various embodiments.

FIG. 12 is a diagram of an exemplary headband haptic device 510 configuration, in accordance with various embodiments. Referring to FIG. 12, the headband haptic device 510 comprises a plurality of haptic device sensors 512 embedded in or otherwise attached to the headband such that the sensors are positioned circumferentially around a listener head 500 when the headband is worn by the listener. Although there are eight (8) haptic device sensors 512 shown in FIG. 12, any suitable number of sensors 512 are envisioned. In a representative embodiment, each haptic device sensor 512, when actuated, corresponds to the direction of the source of the incoming audio relative to the listener 500.

Figure 13:
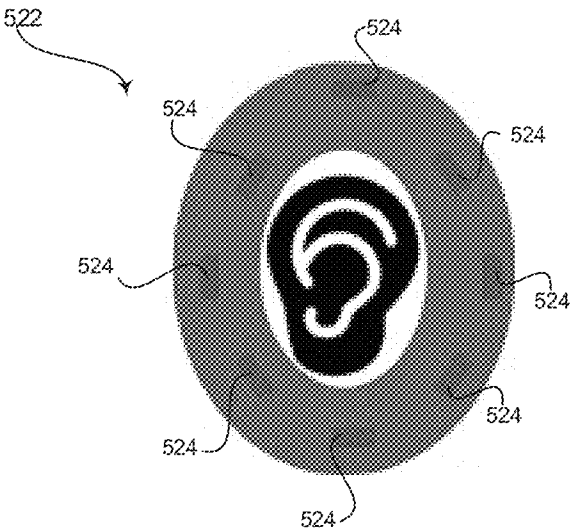
FIG. 13 is a diagram of exemplary headphone haptic device configuration, in accordance with various embodiments.
Figure 13:
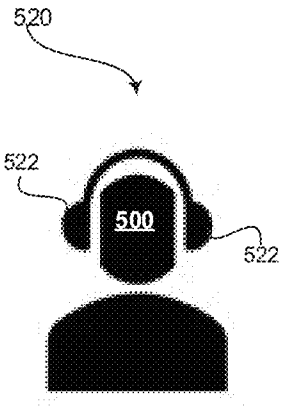

FIG. 13 is a diagram of exemplary headphone haptic device 520 configuration, in accordance with various embodiments. Referring to FIG. 13, the headphone haptic device 520 comprises an earcup 522 for each listener 500 ear. Each of the earcups 522 is configured to substantially surround the listener ear and comprises a plurality of haptic device sensors 524 embedded in or otherwise attached to the earcup 522 such that the sensors 524 are positioned circumferentially around a listener ear when the headphone 520 is worn by the listener 500. Although there are eight (8) haptic device sensors 524 shown in each ear pad 522 of FIG. 13, any suitable number of sensors 524 are envisioned. In a representative embodiment, each haptic device sensor 524, when actuated, corresponds to the direction of the source of the incoming audio relative to the listener 500.

Figure 14:
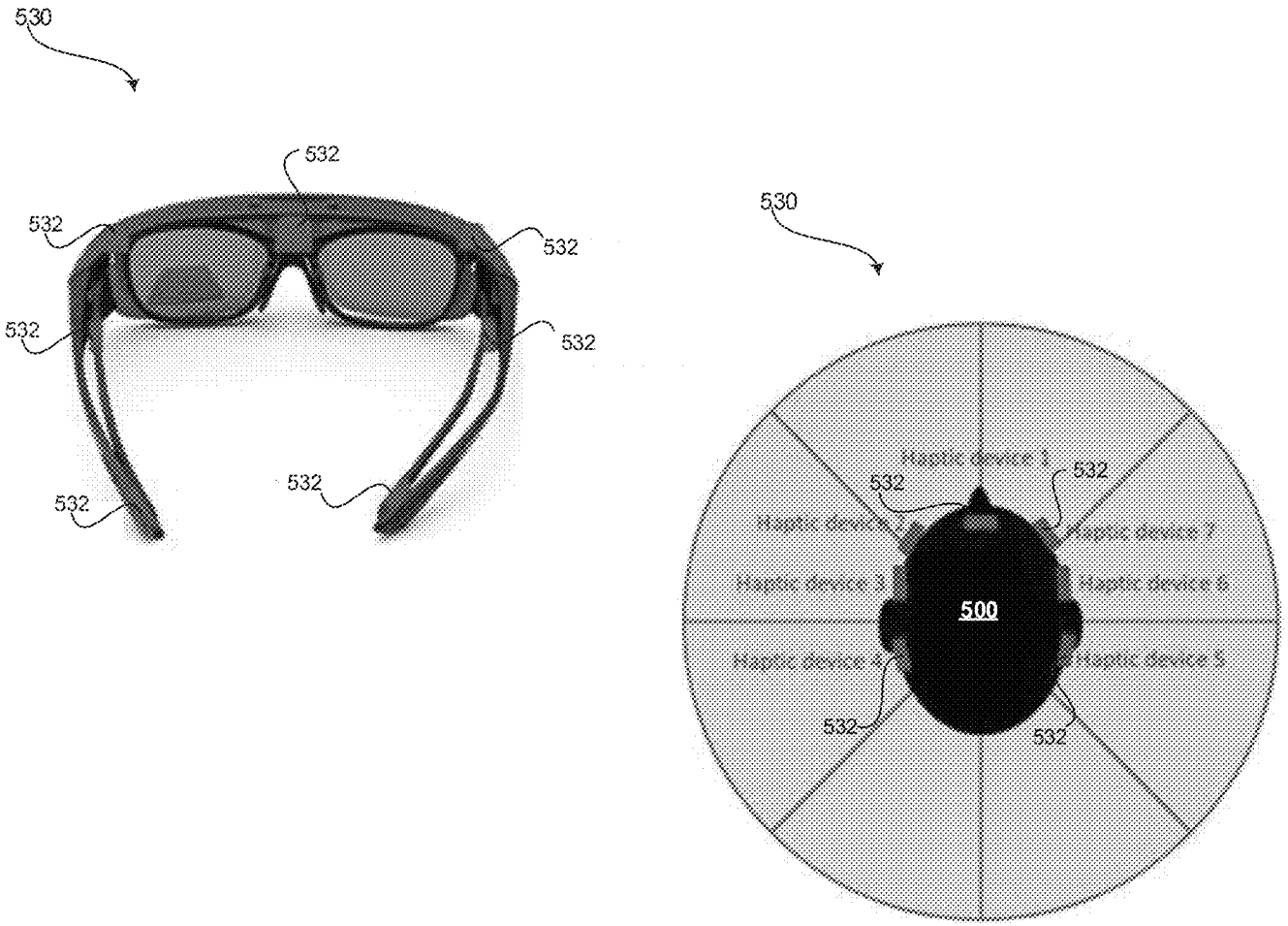
FIG. 14 is a diagram of exemplary eyeglass haptic device configuration, in accordance with various embodiments.

FIG. 14 is a diagram of exemplary eyeglass haptic device 530 configuration, in accordance with various embodiments. Referring to FIG. 14, the eyeglass haptic device 530 comprises a plurality of haptic device sensors 532 embedded or otherwise attached to eyeglasses 530, googles, a face mask, or the like. The haptic device sensors 532 are positioned such that each sensor 532 is pressed against the listener head 500 when the eyeglasses 532, googles, face mask, or the like is worn by the listener 500. For example, the haptic device sensors 532 may be positioned on the temple arms, temple tips, top bar, bridge, rims, or any suitable component of the eyeglasses 530. Although there are seven (7) haptic device sensors 532 shown in the eyeglasses 530 of FIG. 14, any suitable number of sensors 532 are envisioned. In a representative embodiment, each haptic device sensor 532, when actuated, corresponds to the direction of the source of the incoming audio relative to the listener 500.

In various embodiments, the location broadcast protocol of the system correlates location data to each voice or sound transmission. The location data may be encrypted to protect a location of the user from eavesdropping or unwanted location detection. The location data may be modulated or otherwise embedded with the audio signal and sent over the audio channel of the communications device (radio, mobile phone, intercom, etc.). The location data may be sent via a data channel of the communication device if such channel exists or is accessible. The location data may be sent via a secondary device or method.

The system accommodates many-to-one communication and is not limited to a point-to-point application. The directional information is particularly beneficial in situations where users are separated by distance or without the benefit of visual contact. Various embodiments are predicated on the ability for User A to establish his/her own GPS (or BLE Beacon, WiFi Access Point, or other suitable location identification technology) location, altitude, and compass coordinates and that the remote talker/device (User B) is able to broadcast its GPS (or BLE Beacon, WiFi Access Point, or other suitable location identification technology) location and altitude during audio transmissions or at regular time intervals. User A receives User B's location information and computes the direction to User B in relation to User A's geographic position. The information allows User A to assess in real time the orientation and any subsequent movement of User B. Accordingly, User B's movement is communicated to User A via corresponding changes in the perceived direction provided by the artificial sensations created by the haptic devices.

Certain embodiments provide a safety feature for users of portable communication devices by giving the users greater situational awareness of their team members and allowing them to locate each other more effectively without visual contact or the need for users to constantly communicate locations verbally. The safety feature may be beneficial, for example, in an urban environment where there are many buildings or crowds of people, a forested area, a smoke-filled environment, or any situation where the users may be visually obstructed from one another.

Another benefit is to improve the efficiency and effectiveness of users of mobile audio voice communication devices and the communications network itself. Using directional haptic feedback to communicate directional information reduces the time and effort of verbally communicating and interpreting location/coordinates by both the sender and recipient, thereby freeing up the users to better focus on mission critical activities. Less verbal communication has the added benefit of reducing audio traffic on critical communication networks.

In various embodiments, anywhere from two to an unlimited number of users are wearing specially designed location awareness stereo headsets, earphones, or other audio device (connected into a communication device) incorporated with a GPS (or BLE Beacon, WiFi Access Point, or other suitable location identification technology) receiver to establish global location and digital compass to establish the forward direction of the user's head in relation to the Cartesian coordinates. Each user wearing a location awareness headset broadcasts its own GPS (or BLE Beacon, WiFi Access Point, or other suitable location identification technology) location data to all users in the (wired or wireless) network so that all the other users wearing the same location awareness headsets are aware of each other's locations. The location data may be transmitted at the same time as the speaker's voice, thereby allowing each receiving location awareness headset or suitable audio device to process the incoming data, through head-gear or body-worn devices, and provide a physical sensation corresponding with a perceived direction of the speaker.

The headset to headset location data communication protocol can be superimposed onto (added into) any existing wired or wireless audio communication protocol/system including Land Mobile Radios ("Half-duplex PTT communication systems), Full Duplex wired or wireless Intercoms, Cellphones, Wired POTS phone, VOIP, Bluetooth, etc. The headset to headset location data communication protocol is intended to produce little to no degradation to the audio intelligibility, particularly to the users on the communication system that do not have the location awareness headsets or audio communications devices. In systems where a dedicated data channel is provided, the location data communication protocol can be sent via a digital data channel.

Although various embodiments describe the technology embedded into stereo headsets, the technology may be implemented into primary communications devices such as Land Mobile Radios, Cellphones, Wireless intercoms, etc. and additionally and/or alternatively into audio accessories that attach onto those communication devices including, for example, Remote Speaker Microphones (RSMs), Fireman Self-contained breathing apparatus (SCBA) Masks, Bluetooth headsets and earbuds, or dongle-type accessory attachments for Land Mobile Radio or Cellphones, protective helmets, eye protection devices and glasses, communications system base stations, vehicles, and virtual reality headgear, among other things.

In certain embodiments, the users wearing the location awareness stereo headsets or audio devices, may have a body worn device with a display that communicates visually a more precise direction in addition to distance to the remote user to supplement the physical sensations provided by the haptic devices. The display unit could be a standalone unit, or it could be an application on a smartphone linked via Bluetooth with the location awareness stereo headset.

In an exemplary embodiment, the directional haptic feedback provided by the audio communication system described above may be combined with the 3D, volume, and/or any suitable sound processing algorithms used to create a spatial audio soundscape that allows the receiver (listener) to perceive the spatial direction of each transmitter (speaker) voice transmission in 3D space as described above with respect to FIGS. 5-11.

Visual Feedback

A system and method for determining and displaying, for a listener, the location of a remote speaker relative to the listener each time the remote speaker transmits an audio communications signal through a wireless communications system is provided. The system utilizes the remote speaker's real-time location data and the listener's real-time location data and head orientation to determine the direction, distance, and/or elevation of the speaker relative to the listener. This information is presented on a display device for the listener to view each time the listening device receives audio communications from a remote speaker. More specifically, certain embodiments provide a system and method by which a directional indicator is presented at a display system for visualization by a listener utilizing an audio communications system to listen to audio provided by a speaker at a remote location. The directional indicator presented at the display system corresponds to the geographic direction of the audio source. The directional indicator is generated based on the location data corresponding to the real time location of the listener and real time location data of the speaker that is transmitted with individual audio transmissions. FIG. 3 is a diagram of the perception by a listener of a location of a speaker using audio communications equipment with visual feedback, in accordance with various embodiments. FIG. 4 is a diagram of the perception by a listener of locations of multiple speaker using audio communications equipment with visual feedback, in accordance with various embodiments.

The display device may be in the form of a head-worn device such as a pair of glasses with an embedded screen or projection apparatus, a face shield, or protective mask, among other things. The display device may additionally and/or alternatively be a screen on a hand-held device and a body-worn sensor that takes into account the relative location and orientation of the listener's head or body to determine the speaker's position relative to the listener. The display device may additionally and/or alternatively be a stationary screen at a control center or the like (e.g., 911 call center or aircraft control tower, among other things) that takes into account the relative location and orientation of the screen to determine the speaker's position relative to the listener.

In various embodiments, multiple sensors and microprocessors configured to process the location data from an incoming audio transmission may be embedded into a headband with a display, a face shield, a helmet, a virtual reality headset, or a pair of glasses, for example. The sensors and microprocessors may additionally and/or alternatively be separated from the visual device by being embedded in a band that can be worn around the neck, chest, and/or embedded in a vest or within clothing. The multiple sensors and microprocessors provide the listener, via the display device, with a visual indication of the speaker's location while receiving (hearing) audio communication from a remote speaker that corresponds with the direction of the remote speaker relative to the listener.

In certain embodiments, the display device may be a head-mounted display such as augmented reality glasses, face shields with heads-up display, or helmet, among other things. In such embodiments, a head orientation of the listener may determine a directional orientation. The directional indicator presented at the display device may be configured to continually update to provide the listener with a visual directional indicator that corresponds to the directional location of the remote speaker relative to the listener's head orientation at that point in time. As an example, the visual indicator may update based on changes to a speaker location and/or changes to a head orientation of a listener of the communications from the remote speaker.

In an exemplary embodiment, the display device may be a hand-held or stationary display unit. In such embodiments, the position of the hand-held or stationary device may determine a directional orientation. The directional indicator presented at the hand-held or stationary display device may be configured to continually update to provide the listener with a visual directional indicator that corresponds to the directional location of the remote speaker relative to the stationary position (if a stationary device) or the listener's hand position (if a hand-held device) at that point in time. As an example, the visual indicator may update based on changes to a speaker location and/or changes to a position of the hand-held device held by the listener of the communications from the remote speaker.

The visual indicator may be configured to convey directional information relative to the listener. For example, the visual indicator may be in the form of a symbol (e.g., an arrow or an icon), a number (e.g., a compass coordinate or degree measurement), 360 degree coordinates similar to numbers of a clock (e.g., 12 o'clock corresponding to directly in front of a user), a word (e.g., "left" or "right"), or any suitable indicator. In an exemplary embodiment, the visual display may display numbers, a bar graph, or any suitable indicator to provide information related to a distance of the speaker from the listener. In a representative embodiment, the visual display may show a numeric value, or any suitable indicator specifying an altitude of the speaker. As another example, the visual display may list the altitude of the speaker relative to the listener as floor levels (e.g., "1 floor above") to communicate altitude differences between the speaker and the listener. In certain embodiments, the visual display may distinguish between multiple inbound speaker audio sources by, for example, assigning different visual elements to the different speakers. Examples of different visual elements that may distinguish different speaker audio sources may include icons, numbers, letters, images, font styles, and/or location of information presented on the display device. The visual display may be configured to show the icon, numbers, letters, images, and the like that are being displayed in different colors that correspond with different audio sources. For example, if an arrow is being used to indicate the direction of the speaker relative to the listener, the arrow could be designed to appear in a red color when receiving audio from a firefighter and the arrow may appear in a blue color when receiving audio from a police officer.

Figure 15:
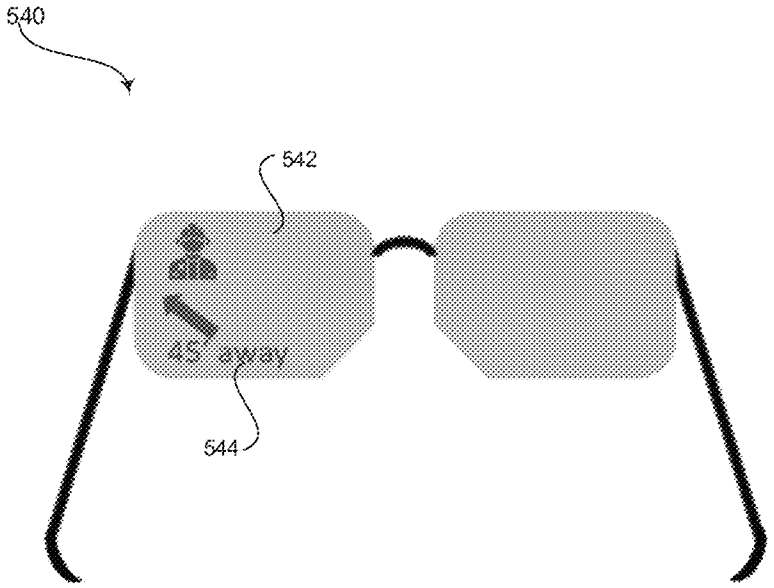
FIGS. 15-18 are diagrams of exemplary speaker locations with respect to listener locations and exemplary visual indications corresponding with the speaker location that are presented at an exemplary display device, in accordance with various embodiments.
Figure 15:
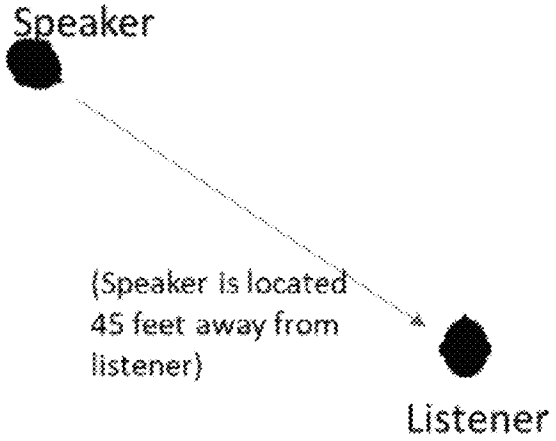

FIGS. 15-18 are diagrams of exemplary speaker locations with respect to listener locations and exemplary visual indications 544 corresponding with the speaker location that are presented at an exemplary display device 540, in accordance with various embodiments. Referring to FIG. 15, a speaker is shown 45 feet away from a listener in a direction in front of and to the left of the listener. The display device 542 is integrated into a lens of a pair of eyeglasses 540 and provides a visual indicator 544 identifying the information regarding the speaker and the location of the speaker. For example, the visual indicator 544 identifies the source of the audio communications with a fireman icon, provides a directional arrow showing the audio communications coming from in front of and to the left of the listener, and provides a distance of 45' away. Although the display device 542 is shown as a lens of eyeglasses 540, any suitable display device may be implemented, such as a hand-held display device, body-worn display device, or other head-mounted display devices.

Figure 16:
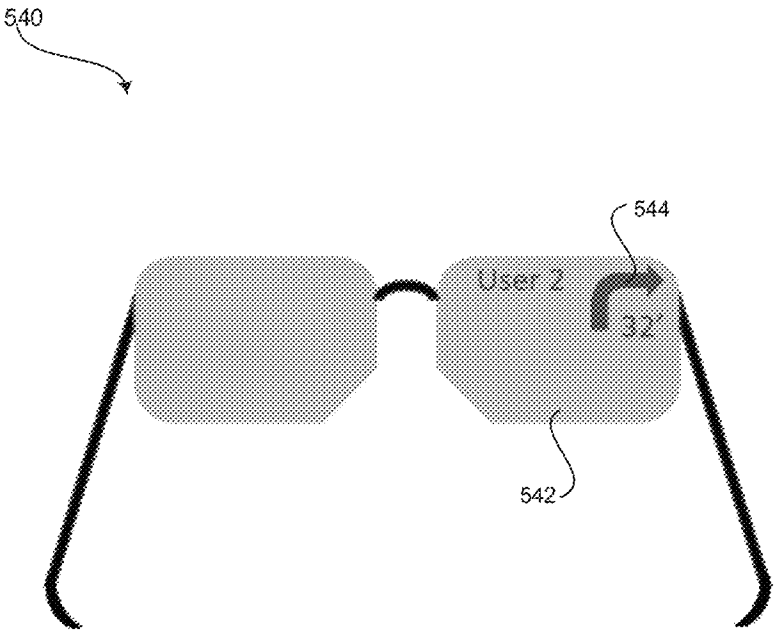
Figure 16:
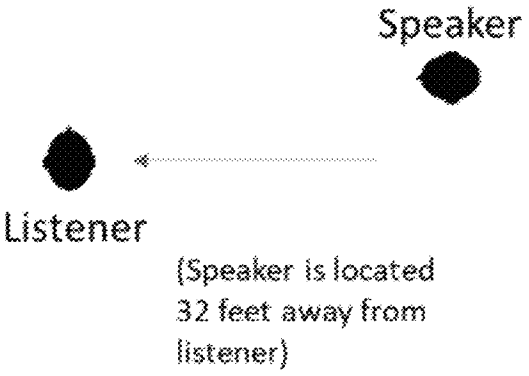

Referring to FIG. 16, a speaker is shown 32 feet away from a listener in a direction in front of and to the right of the listener. The display device 542 is integrated into a lens of a pair of eyeglasses 540 and provides a visual indicator 544 identifying the information regarding the speaker and the location of the speaker. For example, the visual indicator 544 identifies the source of the audio communications with text stating "User 2," provides a directional arrow showing the audio communications coming from in front of and to the right of the listener, and provides a distance of 32'. Although the display device 542 is shown as a lens of eyeglasses 540, any suitable display device may be implemented, such as a hand-held display device, body-worn display device, or other head-mounted display devices.

Figure 17:
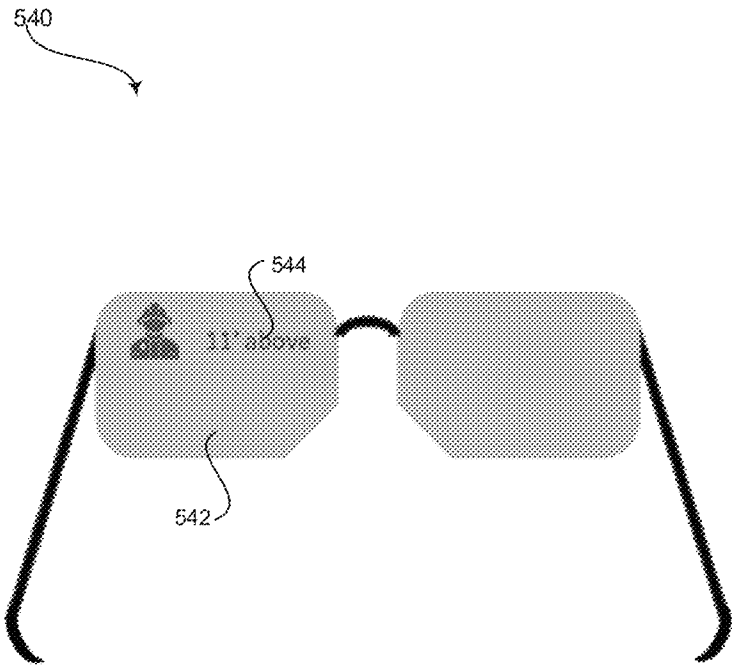
Figure 17:
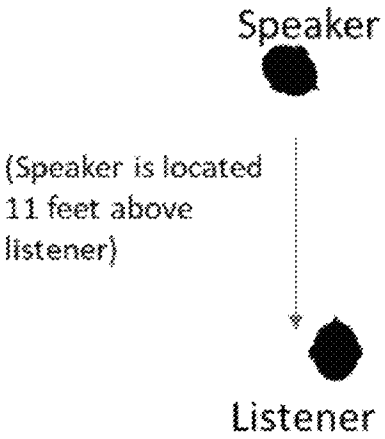

Referring to FIG. 17, a speaker is shown 11 feet above a listener. The display device 542 is integrated into a lens of a pair of eyeglasses 540 and provides a visual indicator 544 identifying the information regarding the speaker and the location of the speaker. For example, the visual indicator 544 identifies the source of the audio communications with a fireman icon and provides textual and numerical information stating that the distance of the speaker is "11' above." Although the display device 542 is shown as a lens of eyeglasses 540, any suitable display device may be implemented, such as a hand-held display device, body-worn display device, or other head-mounted display devices.

Figure 18:
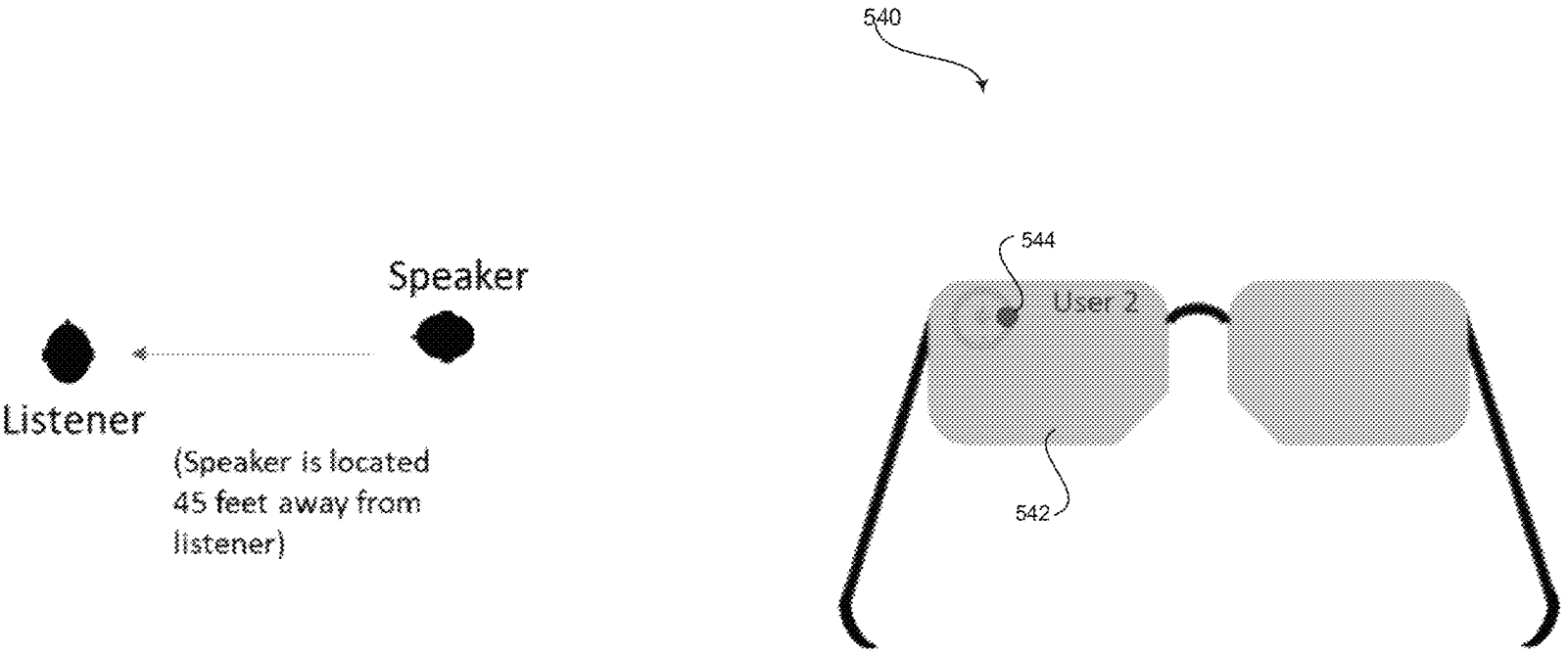

Referring to FIG. 18, a speaker is shown 45 feet away from a listener in a direction to the right of the listener. The display device 542 is integrated into a lens of a pair of eyeglasses 540 and provides a visual indicator 544 identifying the information regarding the speaker and the direction of the speaker. For example, the visual indicator 544 identifies the source of the audio communications with text stating "User 2" and provides a compass icon with a dot to the right of center in the compass. Although the display device 542 is shown as a lens of eyeglasses 540, any suitable display device may be implemented, such as a hand-held display device, body-worn display device, or other head-mounted display devices.

Various embodiments provide a method for audio voice communications systems that utilizes geospatial information corresponding to the actual physical locations of the transmitter and the receiver to provide the receiver with a realistic directional rendering of the audio signal. The method allows the receiver to hear the direction of the transmitted audio voice communications and determine the audio voice communication transmitter's general physical location. The method incorporates 3D audio processing techniques to provide a directional hearing experience by utilizing real-time or near real-time geospatial data to communicate directional information (from a current location toward a remote location) by processing audio to spatially position the audio communications to sound to the receiver as though it was originating from the direction of the remote transmitter's location. In an exemplary embodiment, 3D audio techniques enhance sound localization and allow the user to perceive the direction of the audio source by creating a position relationship between the source of the sound and ears of the user. The 3D audio techniques utilize sound processing algorithms, including the Head Related Transfer Function (HRTF), to alter the audio signals sent to the left and right ears of the user to provide a good perceptual sensation through 3D sound generation. In various embodiments, the geospatial data being communicated during the audio transmission is dynamic such that one or both of the transmitter and receiver may be in motion or have the ability to easily change physical locations. In certain embodiments, the transmitting and/or receiving audio communications devices may be a hand-held or portable device. In a representative embodiment, the physical locations of the transmitter and/or receiver may be dynamic and the geo spatial data may be relayed in real-time or near real-time. The geospatial location may be temporarily estimated or simulated if either the transmitter or receiver is temporarily unable to establish its physical location. In an exemplary embodiment, the transmitting device may transmit its geospatial data continuously during the audio transmission, at the beginning of the audio transmission, and/or at intervals during the audio transmission. In certain embodiments, an auxiliary device for locating the physical location of the transmitter may be used by the receiving communications device to simulate the location of the transmitter relative to the receiver.

Certain embodiments provide a method for combining data regarding physical location coordinates (geospatial data) of a transmitter with an audio signal that is transmitted over a wired or wireless communication network. The method may include modulating and processing location data to reliably and faithfully pass through a band-limited voice channel employing noise cancelling and vocoders. In various embodiments, a transmitted location data packet may precede the audio or be interleaved with the audio. The addition of the transmitted location data produces minimal impact to the communication system noise and the intelligibility of the voice(s) of user(s) present in the audio signal. Aspects of the present disclosure provide a method for extracting remote transmitter physical location coordinates (geospatial data) embedded with an audio signal and comparing the transmitter location data with physical location coordinates of the receiver to establish relative altitude, distance, and direction from the transmitter to the receiver. Various embodiments provide a communications headset with circuitry to identify its location coordinates or position using GPS, Global Navigation Satellite System (GNSS), BLE Beacon, WiFi Access Point, Altimeter, Inertial navigation system (INS), or any suitable location identification technology and the circuitry to include or embed the location coordinates onto or with the transmitted audio. Certain embodiments provide a hand-held radio or mobile communications device with circuitry to identify its location coordinates or position using GPS, Global Navigation Satellite System (GNSS), BLE Beacon, WiFi Access Point, Altimeter, Inertial navigation system (INS), or any suitable location identification technology and the circuitry to include or encode the geospatial location coordinates onto or with the transmitted audio.

In various embodiments, a push to talk (PTT) switch, remote speaker microphone (RSM) device, body-mounted camera device, and/or vehicle mounted audio transmit device used in land-mobile radios or telecommunications systems may comprise circuitry to identify its location coordinates or position using GPS, Global Navigation Satellite System (GNSS), BLE Beacon, WiFi Access Point, Altimeter, Inertial navigation system (INS), or any suitable location identification technology and circuitry to include or encode the geospatial location coordinates onto or with the transmitted audio.

In certain embodiments, ear buds, a protective helmet, eye protection devices (such as glasses), and/or virtual reality headsets with attached or embedded audio components may comprise circuitry to identify its location coordinates or position using GPS, Global Navigation Satellite System (GNSS), BLE Beacon, WiFi Access Point, Altimeter, Inertial navigation system (INS), or any suitable location identification technology and the circuitry to include or encode the geospatial location coordinates onto or with the transmitted audio.

In an exemplary embodiment, an auxiliary device that connects to an audio system in a vehicle, to a communications base station, or to a portable audio device comprises circuitry to identify its location coordinates or position using GPS, Global Navigation Satellite System (GNSS), BLE Beacon, WiFi Access Point, Altimeter, Inertial navigation system (INS), or any suitable location identification technology and the circuitry to include or encode the geospatial location coordinates onto or with the transmitted audio.

Aspects of the present disclosure provide a communications headset, a remote speaker microphone, a hand-held radio or mobile communications device, a push to talk (PTT) switch, a vehicle mounted radio system, an aircraft-mounted radio system, a helmet or protective headgear, a marine-vessel mounted radio system, and/or ear buds comprising circuitry to identify, decode, and/or extract location data from a received audio signal and then compare that information to its location and head orientation to render (utilizing 3D audio techniques) a realistic audio representation of the location of the transmitter relative to the receiver.

Certain embodiments provide an auxiliary device that connects to an audio system in a vehicle, to a communications base station, or to a portable audio device, the auxiliary device comprising circuitry configured to identify, decode and/or extract location data from a received audio signal and then compare that information to its location and head orientation to render (utilizing 3D audio processing techniques) a realistic audio representation of the transmitter's location relative to the receiver.

In various embodiments, the location coordinates may be synthesized with a synthesized voice in order to create a voice location beacon. In exemplary embodiments, biometric data of a transmitter may be embedded with and recovered from an audio signal transmitted over a wired or wireless communication network. In a representative embodiment, the HRTF filters may be customized for each specific user to provide precisely positioned spatially directional audio. Certain embodiments provide a recall button with the location awareness accessory. The recall button may be configured, for example, to repeat the last spatially positioned audio transmission or provide a synthesized voice that verbally communicates a precise direction and distance for the last transmission. In certain embodiments, the spatial audio processing may be self-contained within a listening device (e.g., binaural headphones) or may reside off-board (e.g., within a software application residing on a data or audio-linked portable or handheld device, such as a smart phone, tablet, laptop, or the like.

Certain embodiments provided altered audio pitch, altered audio amplitude and/or introduce synthesized voice, tone, and/or haptic sensation (vibration) to communicate distance in addition to direction. For example, synthesized voice (communicating location information of incoming audio) may complement or substitute for the spatial positioning of the audio.

Various embodiments provide a notification indicating whether the incoming audio is tagged with location data and may inform the receiver via tone, haptic sensation (vibration), or other visual or audible notification whether the spatial positioning is valid or recent. In certain embodiments, the plurality of speakers may be stereo speakers, surround-sound speakers, speaker-arrays, binaural headphones, and/or any suitable speakers.

Aspects of the present disclosure provide a directional awareness audio communications system comprising a communications device receiver 200, 200*a*, 400. The communications device receiver 200, 200*a*, 400 may comprise a location identification device 208, 210, 412, 414, a location data processor 206, 416, an audio processor 212, 418, 420, and at least one speaker 214, 216, 422, 424. The location identification device 208, 210, 412, 414 may be integrated with or communicatively coupled to the communications device receiver 200, 200*a*, 400. The location identification device 208, 210, 412, 414 may be configured to provide receiver location data and receiver orientation data of the communications device receiver 200, 200*a*, 400. The location data processor 206, 416 may be configured to receive the receiver location data and the receiver orientation data from the location identification device 208, 210, 412, 414. The location data processor 206, 416 may be configured to determine whether a transmitter location data signal 116 identifying a remote location of a communications device transmitter 100, 100*a*, 300 has been received. The location data processor 206, 416 may be configured to provide a warning when the transmitter location data signal 116 has not been received. The location data processor 206, 416 may be configured to compute, when the transmitter location data signal has been received, a directional vector between the communications device transmitter 100, 100*a*, 300 and the communications device receiver 200, 200*a*, 400 based on the transmitter location data signal 116, the receiver location data, and the receiver orientation data. The audio processor 212, 418, 420 may be configured to receive a transmitter audio signal 114 from the communications device transmitter 100, 100*a*, 300. The audio processor 212, 418, 420 may be configured to operate in an enhanced audio mode when the transmitter location data signal 116 has been received by the location data processor 206, 416 or in a standard audio mode when the transmitter location data signal 116 has not been received by the location data processor 206, 416. The audio processor 212, 418, 420 may be configured to process the transmitter audio signal 114 based on the directional vector to convert the transmitter audio signal 114 to a directionally-enhanced audio signal when operating in the enhanced audio mode. The audio processor 212, 418, 420 may be configured to provide one of a standard mono audio signal or a standard stereo signal when operating in the standard audio mode. The at least one speaker 214, 216, 422, 424 may be integrated with or communicatively coupled to the communications device receiver 200, 200*a*, 400. The at least one speaker 214, 216, 422, 424 may be configured to output the directionally-enhanced audio signal, the standard mono audio signal, or the standard stereo signal provided by the audio processor 212, 418, 420.

In a representative embodiment, the warning provided by the location data processor 206, 416 may be one or more of an audio signal output by the at least one speaker 214, 216, 422, 424, a visual warning presented at a display device 542, and a physical warning provided by a haptic device 512, 524, 532. In an exemplary embodiment, the at least one speaker 214, 216, 422, 424 is a plurality of speakers 214, 216, 422, 424 and the audio processor 212, 418, 420 may be configured to apply head-related transfer function (HRTF) filters to convert the transmitter audio signal 114 to the directionally-enhanced audio signal when operating in the enhanced audio mode. In various embodiments, the at least one speaker 214, 216, 422, 424 is a plurality of speakers 214, 216, 422, 424 and the audio processor 212, 418, 420 is configured to apply volume sound processing algorithms to adjust a volume of one or more of the plurality of speakers 214, 216, 422, 424 to provide the directionally-enhanced audio signal when operating in the enhanced audio mode. In certain embodiments, the at least one speaker 214, 216, 422, 424 is a plurality of speakers 214, 216, 422, 424 and the audio processor 212, 418, 420 may be configured to provide a spatially-positioned audible sound with the transmitter audio signal 114 to generate the directionally-enhanced audio signal when operating in the enhanced audio mode. In a representative embodiment, the communications device receiver 200, 200*a*, 400 may comprise a demultiplexer 202, 406 configured to receive a composite signal 112 from the communications device transmitter 100, 100*a*, 300. The demultiplexer 202, 406 may be configured to separate the composite signal 112 into the transmitter audio signal 114 provided to the audio processor 212, 418, 420 and the transmitter location data signal 116 provided to the location data processor 206, 416. In an exemplary embodiment, the communications device receiver 200, 200*a*, 400 may separately receive the transmitter audio signal 114 and the transmitter location data signal 116.

In certain embodiments, the directional awareness audio communications system may comprise the communications device transmitter 100, 100*a*, 300. The communications device transmitter 100, 100*a*, 300 may comprise at least one microphone 102, 310, a transmitter location identification device 104, 302, and a transmitter location data processor 106, 304. The at least one microphone 102, 310 may be configured to generate the transmitter audio signal. The transmitter location identification device 104, 302 may be integrated with or communicatively coupled to the communications device transmitter 100, 100*a*, 300. The transmitter location identification device 104, 302 may be configured to provide transmitter location data of the communications device transmitter 100, 100*a*, 300. The transmitter location data processor 106, 304 may be configured to receive and format the transmitter location data to generate the transmitter location data signal 116. The transmitter audio signal 114 and the transmitter location data signal 116 may be transmitted separately from the communications device transmitter 100, 100*a*, 300 to the communications device receiver 200, 200*a*, 400. The transmitter audio signal 114 and the transmitter location data signal 116 may be multiplexed to form a composite signal 112 that is transmitted from the communications device transmitter 100, 100*a*, 300 to the communications device receiver 200, 200*a*, 400. In various embodiments, the directional awareness audio communications system may comprise a user-worn device 510, 520, 530 communicatively coupled to the communications device receiver 200, 200*a*, 400. The user-worn device 510, 520, 530 may comprise a plurality of haptic sensors 512, 524, 532 and at least one processor. The plurality of haptic sensors 512, 524, 532 may be configured to pulse in response to a drive signal received during output of the directionally-enhanced audio signal by the at least one speaker 214, 216, 422, 424. The at least one processor may be configured to generate and provide the drive signal to at least one of the plurality of haptic sensors 512, 524, 532 based on the directional vector computed by the location data processor 206, 416. In a representative embodiment, the user-worn device 510, 520, 530 is a headband 510, headphones 520, ear buds, eyeglasses 530, and/or a body-worn device. In an exemplary embodiment, the directional awareness audio communications system may comprise a display device 540 communicatively coupled to the communications device receiver 200, 200*a*, 400. The display device 540 may comprise a display screen 542 configured to present a visual indicator 544 based on the directional vector computed by the location data processor 206, 416. The visual indicator 544 may be presented during output of the directionally-enhanced audio signal by the at least one speaker 214, 216, 422, 424. The visual indicator 544 may identify a direction of the communications device transmitter 100, 100*a*, 300 from the communications device receiver 200, 200*a*, 400, a distance of the communications device transmitter 100, 100*a*, 300 from the communications device receiver 200, 200*a*, 400, and/or an identifier corresponding to the communications device transmitter 100, 100*a*, 300. In certain embodiments, the display device 540 is a head-worn device, a hand-held device, a body-worn device, and/or a vehicle-mounted device.

Various embodiments provide a method comprising providing, by a location identification device 208, 210, 412, 414 integrated with or communicatively coupled to the communications device receiver 200, 200*a*, 400, receiver location data and receiver orientation data of the communications device receiver 200, 200*a*, 400. The method may comprise receiving, by a location data processor 206, 416 of the communications device receiver 200, 200*a*, 400, the receiver location data and the receiver orientation data from the location identification device 208, 210, 412, 414. The method may comprise determining, by the location data processor 206, 416, whether a transmitter location data signal 116 identifying a remote location of a communications device transmitter 100, 100*a*, 300 has been received. The method may comprise providing, by the location data processor 206, 416, a warning when the transmitter location data signal 116 has not been received. The method may comprise computing, by the location data processor 206, 416, a directional vector between the communications device transmitter 100, 100*a*, 300 and the communications device receiver 200, 200*a*, 400 based on the transmitter location data signal 116, the receiver location data, and the receiver orientation data when the transmitter location data signal 116 has been received. The method may comprise receiving, by an audio processor 212, 418, 420 of the communications device receiver 200, 200*a*, 400, a transmitter audio signal 114 from the communications device transmitter 100, 100*a*, 300. The method may comprise operating, by the audio processor 212, 418, 420, in an enhanced audio mode by processing the transmitter audio signal 114 based on the directional vector to convert the transmitter audio signal 114 to a directionally-enhanced audio signal when the transmitter location data signal 116 has been received by the location data processor 206, 416. The method may comprise operating, by the audio processor 212, 418, 420, in a standard audio mode by providing one of a standard mono audio signal or a standard stereo signal when the transmitter location data signal 116 has not been received by the location data processor 206, 416. The method may comprise outputting, by at least one speaker 214, 216, 422, 424 integrated with or communicatively coupled to the communications device receiver 200, 200*a*, 400, the directionally-enhanced audio signal, the standard mono audio signal, or the standard stereo signal provided by the audio processor 212, 418, 420.

In an exemplary embodiment, the warning provided by the location data processor 206, 416 is one or more of an audio signal output by the at least one speaker 214, 216, 422, 424, a visual warning presented at a display device 540, and a physical warning provided by a haptic device 512, 524, 532. In certain embodiments, the at least one speaker 214, 216, 422, 424 is a plurality of speakers 214, 216, 422, 424 and operating, by the audio processor 212, 418, 420, in the enhanced audio mode comprises applying head-related transfer function (HRTF) filters to convert the transmitter audio signal 114 to the directionally-enhanced audio signal. In various embodiments, the at least one speaker 214, 216, 422, 424 is a plurality of speakers 214, 216, 422, 424 and operating, by the audio processor 212, 418, 420, in the enhanced audio mode comprises applying volume sound processing algorithms to adjust a volume of one or more of the plurality of speakers 214, 216, 422, 424 to provide the directionally-enhanced audio signal. In a representative embodiment, the at least one speaker 214, 216, 422, 424 is a plurality of speakers 214, 216, 422, 424 and operating, by the audio processor 212, 418, 420, in the enhanced audio mode comprises providing a spatially-positioned audible sound with the transmitter audio signal 114 to generate the directionally-enhanced audio signal. In an exemplary embodiment, the method comprises receiving, by a demultiplexer 202, 406 of the communications device receiver 200, 200*a*, 400, a composite signal 112 from the communications device transmitter 100, 100*a*, 300. The method comprises separating, by the demultiplexer 202, 406, the composite signal 112 into the transmitter audio signal 114 provided to the audio processor 212, 418, 420 and the transmitter location data signal 116 provided to the location data processor 206, 416. In certain embodiments, the method comprises separately receiving, by the communications device receiver 200, 200*a*, 400, the transmitter audio signal 114 and the transmitter location data signal 116.

In various embodiments, the method comprises generating, by at least one microphone 102, 310 of the communications device transmitter 100, 100*a*, 300, the transmitter audio signal 114. The method may comprise providing, by a transmitter location identification device 104, 302 integrated with or communicatively coupled to the communications device transmitter 100, 100*a*, 300, transmitter location data 116 of the communications device transmitter 100, 100*a*, 300. The method may comprise receiving and formatting, by a transmitter location data processor 106, 304 of the communications device transmitter 100, 100*a*, 300, the transmitter location data to generate the transmitter location data signal 116. The method may comprise transmitting, from the communications device transmitter 100, 100*a*, 300 to the communications device receiver 200, 200*a*, 400, the transmitter audio signal 114 and the transmitter location data signal 116 either separately or as a composite signal 112. In a representative embodiment, the method may comprise generating, by at least one processor of a user-worn device 510, 520, 530 communicatively coupled to the communications device receiver 200, 200*a*, 400, a drive signal based on the directional vector computed by the location data processor 206, 416. The method may comprise pulsing, at least one of a plurality of haptic sensors 512, 524, 532 of the user-worn device 510, 520, 530, in response to a drive signal received during output of the directionally-enhanced audio signal by the at least one speaker 214, 216, 422, 424. In an exemplary embodiment, the user-worn device 510, 520, 530 is a headband 510, headphones 520, ear buds, eyeglasses 530, and/or a body-worn device. In certain embodiments, the method may comprise presenting, at a display screen 542 of a display device 540 communicatively coupled to the communications device receiver 200, 200*a*, 400, a visual indicator 544 based on the directional vector computed by the location data processor 206, 416. The visual indicator 544 may be presented during output of the directionally-enhanced audio signal by the at least one speaker 214, 216, 422, 424. The visual indicator 544 may identify a direction of the communications device transmitter 100, 100*a*, 300 from the communications device receiver 200, 200*a*, 400, a distance of the communications device transmitter 100, 100*a*, 300 from the communications device receiver 200, 200*a*, 400, and/or an identifier corresponding to the communications device transmitter 100, 100*a*, 300. In various embodiments, the display device 540 is a head-worn device, a hand-held device, a body-worn device, and/or a vehicle-mounted device.

Certain embodiments provide a directional awareness audio communications system comprising a communications device receiver 200, 200*a*, 400. The communications device receiver 200, 200*a*, 400 may comprise a location identification device 210, 414, a Radio Direction Finding (RDF) device, a location data processor 206, 416, an audio processor 212, 418, 420, and a plurality of speakers 214, 216, 422, 424. The location identification device 210, 414 may be integrated with or communicatively coupled to the communications device receiver 200, 200*a*, 400. The location identification device 210, 414 may be configured to provide receiver orientation data of the communications device receiver 200, 200*a*, 400. The RDF device may be integrated with or communicatively coupled to the communications device receiver 200, 200*a*, 400. The RDF device may comprise an RDF processor and at least one antenna. The RDF device may be configured to generate a transmitter location data signal identifying a remote location of a communications device transmitter 100, 100*a*, 300 with respect to the communications device receiver 200, 200*a*, 400. The location data processor 206, 416 may be configured to receive the receiver orientation data from the location identification device 210, 414. The location data processor 206, 416 may be configured to receive the transmitter location data signal from the RDF device. The location data processor 206, 416 may be configured to compute a directional vector between the communications device transmitter 100, 100*a*, 300 and the communications device receiver 200, 200*a*, 400 based on the transmitter location data signal and the receiver orientation data. The audio processor 212, 418 may be configured to receive a transmitter audio signal from the communications device transmitter 100, 100*a*, 300. The audio processor 212, 418 may be configured to process the transmitter audio signal based on the directional vector to convert the transmitter audio signal to a directionally-enhanced audio signal. The plurality of speakers 214, 216, 422, 424 may be integrated with or communicatively coupled to the communications device receiver 200, 200*a*, 400. The plurality of speakers 214, 216, 422, 424 may be configured to output the directionally-enhanced audio signal provided by the audio processor 212, 418.

In various embodiments, the audio processor 212, 418 may be configured to apply head-related transfer function (HRTF) filters to convert the transmitter audio signal to the directionally-enhanced audio signal. In certain embodiments, the audio processor 212, 418 may be configured to apply volume sound processing algorithms to adjust a volume of one or more of the plurality of speakers 214, 216, 422, 424 to provide the directionally-enhanced audio signal. In a representative embodiment, the audio processor 212, 418 may be configured to provide a spatially-positioned audible sound with the transmitter audio signal to generate the directionally-enhanced audio signal. In an exemplary embodiment, the directional awareness audio communications system may comprise the communications device transmitter 100, 100*a*, 300 comprising at least one microphone 102, 310 configured to generate the transmitter audio signal. The transmitter audio signal is transmitted from the communications device transmitter 100, 100*a*, 300 to the communications device receiver 200, 200*a*, 400. In various embodiments, the directional awareness audio communications system may comprise a user-worn device 510, 520, 522, 530 communicatively coupled to the communications device receiver 200, 200*a*, 400. The user-worn device 510, 520, 522, 530 may comprise a plurality of haptic sensors 512, 524, 532 configured to pulse in response to a drive signal received during output of the directionally-enhanced audio signal by the plurality of speakers 214, 216, 422, 424. The user-worn device 510, 520, 522, 530 may comprise at least one processor configured to generate and provide the drive signal to at least one of the plurality of haptic sensors 512, 524, 532 based on the directional vector computed by the location data processor 206, 416. In certain embodiments, the directional awareness audio communications system may comprise a display device 540 communicatively coupled to the communications device receiver 200, 200*a*, 400. The display device 540 may comprise a display screen 542 configured to present a visual indicator 544 based on the directional vector computed by the location data processor 206, 416. The visual indicator 544 may be presented during output of the directionally-enhanced audio signal by the plurality of speakers 214, 216, 422, 424. The visual indicator 544 may identify a direction of the communications device transmitter 100, 100*a*, 300 from the communications device receiver 200, 200*a*, 400, a distance of the communications device transmitter 100, 100*a*, 300 from the communications device receiver 200, 200*a*, 400, and/or an identifier corresponding to the communications device transmitter 100, 100*a*, 300.

Various embodiments provide a method comprising providing, by a location identification device 210, 414 integrated with or communicatively coupled to a communications device receiver 200, 200*a*, 400, receiver orientation data of the communications device receiver 200, 200*a*, 400. The method may comprise generating, by a Radio Direction Finding (RDF) device integrated with or communicatively coupled to the communications device receiver 200, 200*a*, 400, a transmitter location data signal identifying a remote location of a communications device transmitter 100, 100*a*, 300 with respect to the communication device receiver 200, 200*a*, 400. The method may comprise receiving, by a location data processor 206, 416 of the communications device receiver 200, 200*a*, 400, the receiver orientation data from the location identification device 210, 414. The method may comprise receiving, by the location data processor 206, 416, the transmitter location data signal from the RDF device. The method may comprise computing, by the location data processor 206, 416, a directional vector between the communications device transmitter 100, 100*a*, 300 and the communications device receiver 200, 200*a*, 400 based on the transmitter location data signal and the receiver orientation data. The method may comprise receiving, by an audio processor 212, 418, 420 of the communications device receiver 200, 200*a*, 400, a transmitter audio signal 114 from the communications device transmitter 100, 100*a*, 300. The method may comprise processing, by the audio processor 212, 418, 420, the transmitter audio signal 114 based on the directional vector to convert the transmitter audio signal 114 to a directionally-enhanced audio signal. The method may comprise outputting, by a plurality of speakers 214, 216, 422, 424 integrated with or communicatively coupled to the communications device receiver 200, 200*a*, 400, the directionally-enhanced audio signal provided by the audio processor 212, 418, 420.

In an exemplary embodiment, the processing the transmitter audio signal 114 may comprise applying, by the audio processor 212, 418, 420, head-related transfer function (HRTF) filters to convert the transmitter audio signal 114 to the directionally-enhanced audio signal. In a representative embodiment, the processing the transmitter audio signal 114 may comprise applying, by the audio processor 212, 418, 420, volume sound processing algorithms to adjust a volume of one or more of the plurality of speakers 214, 216, 422, 424 to provide the directionally-enhanced audio signal. In certain embodiments, the processing the transmitter audio signal 114 comprises providing, by the audio processor 212, 418, 420, a spatially-positioned audible sound with the transmitter audio signal 114 to generate the directionally-enhanced audio signal. In various embodiments, the method may comprise generating, by at least one microphone 102, 310 of the communications device transmitter 100, 100*a*, 300, the transmitter audio signal 114. The method may comprise transmitting, from the communications device transmitter 100, 100*a*, 300 to the communications device receiver 200, 200*a*, 400, the transmitter audio signal 114. In an exemplary embodiment, the method may comprise generating, by at least one processor of a user-worn device 510, 520, 522, 530 communicatively coupled to the communications device receiver 200, 200*a*, 400, a drive signal based on the directional vector computed by the location data processor 206, 416. The method may comprise pulsing, at least one of a plurality of haptic sensors 512, 524, 532 of the user-worn device 510, 520, 522, 530, in response to a drive signal received during output of the directionally-enhanced audio signal by the plurality of speakers 214, 216, 422, 424. In a representative embodiment, the method may comprise presenting, at a display screen 542 of a display device 540 communicatively coupled to the communications device receiver 200, 200*a*, 400, a visual indicator 544 based on the directional vector computed by the location data processor 206, 416. The visual indicator 544 may be presented during output of the directionally-enhanced audio signal by the plurality of speakers 214, 216, 422, 424. The visual indicator may identify a direction of the communications device transmitter 100, 100*a*, 300 from the communications device receiver 200, 200*a*, 400, a distance of the communications device transmitter 100, 100*a*, 300 from the communications device receiver 200, 200*a*, 400, and/or an identifier corresponding to the communications device transmitter 100, 100*a*, 300.

As utilized herein the term "circuitry" refers to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry or other structure is "operable" or "configured" to perform a function whenever the circuitry or other structure comprises the necessary hardware and code (if any is necessary) to perform the function, regardless of whether performance of the function is disabled, or not enabled, by some user-configurable setting.

Other embodiments of the disclosure may provide a computer readable device and/or a non-transitory computer readable medium, and/or a machine readable device and/or a non-transitory machine readable medium, having stored thereon, a machine code and/or a computer program having at least one code section executable by a machine and/or a computer, thereby causing the machine and/or computer to perform the steps as described herein for providing a listener with a perception of a location of a speaker using audio feedback, haptic feedback, and/or visual feedback.

Accordingly, the present disclosure may be realized in hardware, software, or a combination of hardware and software. The present disclosure may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present disclosure may also be embedded in a computer program product, which comprises all the features enabling the implementation of the methods described herein, and which when loaded in a computer system is able to carry out these methods. Computer program in the present context means any expression, in any language, algorithm, code or notation, of a set of instructions intended to cause a system having an information processing capability to perform a particular function either directly or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What it claimed is:

1. A directional awareness audio communications system comprising:

a communications device receiver comprising:

a location identification device integrated with or communicatively coupled to the communications device receiver, the location identification device configured to provide receiver location data and receiver orientation data of the communications device receiver;

a location data processor configured to:

receive the receiver location data and the receiver orientation data from the location identification device;

determine whether a transmitter location data signal identifying a remote location of a communications device transmitter has been received;

provide a warning when the transmitter location data signal has not been received; and compute, when the transmitter location data signal has been received, a directional vector between the communications device transmitter and the communications device receiver based on the transmitter location data signal, the receiver location data, and the receiver orientation data;

an audio processor configured to:

receive a transmitter audio signal from the communications device transmitter; and operate in an enhanced audio mode when the transmitter location data signal has been received by the location data processor or in a standard audio mode when the transmitter location data signal has not been received by the location data processor, wherein the audio processor is configured to process the transmitter audio signal based on the directional vector to convert the transmitter audio signal to a directionally-enhanced audio signal when operating in the enhanced audio mode, wherein the audio processor is configured to provide one of a standard mono audio signal or a standard stereo signal when operating in the standard audio mode; and at least one speaker integrated with or communicatively coupled to the communications device receiver, the at least one speaker configured to output the directionally-enhanced audio signal, the standard mono audio signal, or the standard stereo signal provided by the audio processor.

2. The directional awareness audio communications system of claim 1, wherein the warning provided by the location data processor is one or more of an audio signal output by the at least one speaker, a visual warning presented at a display device, and a physical warning provided by a haptic device.

3. The directional awareness audio communications system of claim 1, wherein:

the at least one speaker is a plurality of speakers, and the audio processor is configured to apply head-related transfer function (HRTF) filters to convert the transmitter audio signal to the directionally-enhanced audio signal when operating in the enhanced audio mode.

4. The directional awareness audio communications system of claim 1, wherein:

the at least one speaker is a plurality of speakers, and the audio processor is configured to apply volume sound processing algorithms to adjust a volume of one or more of the plurality of speakers to provide the directionally-enhanced audio signal when operating in the enhanced audio mode.

5. The directional awareness audio communications system of claim 1, wherein:

the at least one speaker is a plurality of speakers, and the audio processor is configured to provide a spatially-positioned audible sound with the transmitter audio signal to generate the directionally-enhanced audio signal when operating in the enhanced audio mode.

6. The directional awareness audio communications system of claim 1, comprising a demultiplexer configured to receive a composite signal from the communications device transmitter, the demultiplexer configured to separate the composite signal into the transmitter audio signal provided to the audio processor and the transmitter location data signal provided to the location data processor.

7. The directional awareness audio communications system of claim 1, wherein the communications device receiver separately receives the transmitter audio signal and the transmitter location data signal.

8. The directional awareness audio communications system of claim 1, comprising:

the communications device transmitter comprising:

at least one microphone configured to generate the transmitter audio signal;

a transmitter location identification device integrated with or communicatively coupled to the communications device transmitter, the transmitter location identification device configured to provide transmitter location data of the communications device transmitter; and a transmitter location data processor configured to receive and format the transmitter location data to generate the transmitter location data signal, wherein the transmitter audio signal and the transmitter location data signal are either:

transmitted separately from the communications device transmitter to the communications device receiver, or multiplexed to form a composite signal that is transmitted from the communications device transmitter to the communications device receiver.

9. The directional awareness audio communications system of claim 1, comprising a user-worn device communicatively coupled to the communications device receiver, the user-worn device comprising:

a plurality of haptic sensors configured to pulse in response to a drive signal received during output of the directionally-enhanced audio signal by the at least one speaker; and at least one processor configured to generate and provide the drive signal to at least one of the plurality of haptic sensors based on the directional vector computed by the location data processor.

10. The directional awareness audio communications system of claim 9, wherein the user-worn device is one or more of:

a headband, headphones, ear buds, eyeglasses, and a body-worn device.

11. The directional awareness audio communications system of claim 1, comprising a display device communicatively coupled to the communications device receiver, the display device comprising a display screen configured to present a visual indicator based on the directional vector computed by the location data processor, the visual indicator presented during output of the directionally-enhanced audio signal by the at least one speaker, wherein the visual indicator identifies one or more of:

a direction of the communications device transmitter from the communications device receiver;

a distance of the communications device transmitter from the communications device receiver; and an identifier corresponding to the communications device transmitter.

12. The directional awareness audio communications system of claim 11, wherein the display device is one or more of:

a head-worn device, a hand-held device, a body-worn device, and a vehicle-mounted device.

13. A method comprising:

providing, by a location identification device integrated with or communicatively coupled to the communications device receiver, receiver location data and receiver orientation data of the communications device receiver;

receiving, by a location data processor of the communications device receiver, the receiver location data and the receiver orientation data from the location identification device;

determining, by the location data processor, whether a transmitter location data signal identifying a remote location of a communications device transmitter has been received;

providing, by the location data processor, a warning when the transmitter location data signal has not been received;

computing, by the location data processor, a directional vector between the communications device transmitter and the communications device receiver based on the transmitter location data signal, the receiver location data, and the receiver orientation data when the transmitter location data signal has been received;

receiving, by an audio processor of the communications device receiver, a transmitter audio signal from the communications device transmitter;

operating, by the audio processor, in an enhanced audio mode by processing the transmitter audio signal based on the directional vector to convert the transmitter audio signal to a directionally-enhanced audio signal when the transmitter location data signal has been received by the location data processor;

operating, by the audio processor, in a standard audio mode by providing one of a standard mono audio signal or a standard stereo signal when the transmitter location data signal has not been received by the location data processor; and outputting, by at least one speaker integrated with or communicatively coupled to the communications device receiver, the directionally-enhanced audio signal, the standard mono audio signal, or the standard stereo signal provided by the audio processor.

14. The method of claim 13, wherein the warning provided by the location data processor is one or more of an audio signal output by the at least one speaker, a visual warning presented at a display device, and a physical warning provided by a haptic device.

15. The method of claim 13, wherein:

the at least one speaker is a plurality of speakers, and operating, by the audio processor, in the enhanced audio mode comprises applying head-related transfer function (HRTF) filters to convert the transmitter audio signal to the directionally-enhanced audio signal.

16. The method of claim 13, wherein:

the at least one speaker is a plurality of speakers, and operating, by the audio processor, in the enhanced audio mode comprises applying volume sound processing algorithms to adjust a volume of one or more of the plurality of speakers to provide the directionally-enhanced audio signal.

17. The method of claim 13, wherein:

the at least one speaker is a plurality of speakers, and operating, by the audio processor, in the enhanced audio mode comprises providing a spatially-positioned audible sound with the transmitter audio signal to generate the directionally-enhanced audio signal.

18. The method of claim 13, comprising:

receiving, by a demultiplexer of the communications device receiver, a composite signal from the communications device transmitter; and separating, by the demultiplexer, the composite signal into the transmitter audio signal provided to the audio processor and the transmitter location data signal provided to the location data processor.

19. The method of claim 13, comprising separately receiving, by the communications device receiver, the transmitter audio signal and the transmitter location data signal.

20. The method of claim 13, comprising:

generating, by at least one microphone of the communications device transmitter, the transmitter audio signal;

providing, by a transmitter location identification device integrated with or communicatively coupled to the communications device transmitter, transmitter location data of the communications device transmitter;

receiving and formatting, by a transmitter location data processor of the communications device transmitter, the transmitter location data to generate the transmitter location data signal; and transmitting, from the communications device transmitter to the communications device receiver, the transmitter audio signal and the transmitter location data signal either separately or as a composite signal.

21. The method of claim 13, comprising:

generating, by at least one processor of a user-worn device communicatively coupled to the communications device receiver, a drive signal based on the directional vector computed by the location data processor; and pulsing, at least one of a plurality of haptic sensors of the user-worn device, in response to a drive signal received during output of the directionally-enhanced audio signal by the at least one speaker.

22. The method of claim 21, wherein the user-worn device is one or more of:

a headband, headphones, ear buds, eyeglasses, and a body-worn device.

23. The method of claim 13, comprising presenting, at a display screen of a display device communicatively coupled to the communications device receiver, a visual indicator based on the directional vector computed by the location data processor, the visual indicator presented during output of the directionally-enhanced audio signal by the at least one speaker, wherein the visual indicator identifies one or more of:

a direction of the communications device transmitter from the communications device receiver;

a distance of the communications device transmitter from the communications device receiver; and an identifier corresponding to the communications device transmitter.

24. The method of claim 23, wherein the display device is one or more of:

a head-worn device, a hand-held device, a body-worn device, and a vehicle-mounted device.

* * * * *